US012439997B2

(12) United States Patent
Chan

(10) Patent No.: US 12,439,997 B2
(45) Date of Patent: Oct. 14, 2025

(54) SOLE STRUCTURE FOR ARTICLE OF FOOTWEAR

(71) Applicant: NIKE, Inc., Beaverton, OR (US)

(72) Inventor: Wesley K. Chan, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/500,330

(22) Filed: Nov. 2, 2023

(65) Prior Publication Data

US 2024/0057717 A1 Feb. 22, 2024

Related U.S. Application Data

(63) Continuation of application No. 17/316,604, filed on May 10, 2021, now Pat. No. 11,839,260.

(60) Provisional application No. 63/022,948, filed on May 11, 2020.

(51) Int. Cl.
*A43B 13/18* (2006.01)
*A43B 13/20* (2006.01)

(52) U.S. Cl.
CPC ..... *A43B 13/189* (2013.01); *A43B 13/206* (2013.01)

(58) Field of Classification Search
USPC ..... 36/28, 29
See application file for complete search history.

(56) References Cited

U.S. PATENT DOCUMENTS 4,864,738 A 9/1989 Horovitz
4,999,931 A * 3/1991 Vermeulen ..... A43B 13/185 36/153
5,179,792 A 1/1993 Brantingham
5,713,141 A 2/1998 Mitchell et al.
5,896,682 A 4/1999 Lin
5,952,065 A 9/1999 Mitchell et al.
6,582,786 B1 6/2003 Bonk et al.
(Continued)

FOREIGN PATENT DOCUMENTS

WO WO-200119211 A1 3/2001
WO WO-2019118540 A1 6/2019

OTHER PUBLICATIONS

European Patent Office, International Search Report and Written Opinion of the International Searching Authority for PCT/US2021/031824, dated Aug. 5, 2021.
(Continued)

*Primary Examiner* — Jameson D Collier
*Assistant Examiner* — Matthew R Marchewka
(74) *Attorney, Agent, or Firm* — Honigman LLP; Matthew H. Szalach; Jonathan P. O'Brien

(57) ABSTRACT

A sole structure for an article of footwear includes a bladder having a plurality of tapered chambers including (a) a series of first tapered chambers tapering from a first end on a medial side of the bladder to a second end on a lateral side of the bladder, and (b) one or more second tapered chambers tapering from a first end on the lateral side of the bladder to a second end on the medial side of the bladder. Each of the one or more second tapered chambers is interposed between adjacent ones of the first tapered chambers. The sole structure also includes a chassis disposed on a first side of the bladder and having a plurality of first ribs each disposed between adjacent ones of the first tapered chambers and the second tapered chambers.

20 Claims, 20 Drawing Sheets

(56) References Cited

U.S. PATENT DOCUMENTS

| | | | | |
|---|---|---|---|---|
| 7,448,150 | B1 * | 11/2008 | Davis | A43B 13/203 36/35 B |
| 2003/0144071 | A1 | 7/2003 | Dodge et al. | |
| 2004/0154189 | A1 * | 8/2004 | Wang | A43B 13/12 36/28 |
| 2005/0022423 | A1 * | 2/2005 | Lakic | A43B 5/0407 36/35 B |
| 2005/0268490 | A1 | 12/2005 | Foxen | |
| 2007/0113425 | A1 | 5/2007 | Wakley et al. | |
| 2012/0023775 | A1 | 2/2012 | Reilly et al. | |
| 2012/0285044 | A1 | 11/2012 | Bacon et al. | |
| 2014/0020264 | A1 | 1/2014 | Holt | |
| 2014/0075778 | A1 | 3/2014 | Bruce et al. | |
| 2015/0272271 | A1 | 10/2015 | Campos, II et al. | |
| 2016/0021974 | A1 | 1/2016 | Schindler et al. | |
| 2017/0251756 | A1 | 9/2017 | Meschter et al. | |
| 2018/0303201 | A1 * | 10/2018 | Greene | A43B 13/186 |
| 2018/0338575 | A1 | 11/2018 | Elder et al. | |
| 2020/0375308 | A1 | 12/2020 | Langvin et al. | |

OTHER PUBLICATIONS

USPTO, Non-Final Office Action for U.S. Appl. No. 17/316,604, mailed Nov. 9, 2022.
USPTO, Final Office Action for U.S. Appl. No. 17/316,604, mailed Apr. 20, 2023.
USPTO, Notice of Allowance and Fee(s) Due for U.S. Appl. No. 17/316,604, mailed Aug. 2, 2023.

* cited by examiner

SOLE STRUCTURE FOR ARTICLE OF FOOTWEAR

CROSS REFERENCE TO RELATED APPLICATIONS

This application is a continuation of U.S. application Ser. No. 17/316,604, filed on May 10, 2021, which claims priority under 35 U.S.C. § 119(e) to U.S. Provisional Application No. 63/022,948, filed on May 11, 2020. The disclosure of these prior applications are considered part of the disclosure of this application and are hereby incorporated by reference in their entirety.

FIELD

The present disclosure relates generally to sole structures for articles of footwear and more particularly to sole structures incorporating a fluid-filled bladder having foam inserts.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
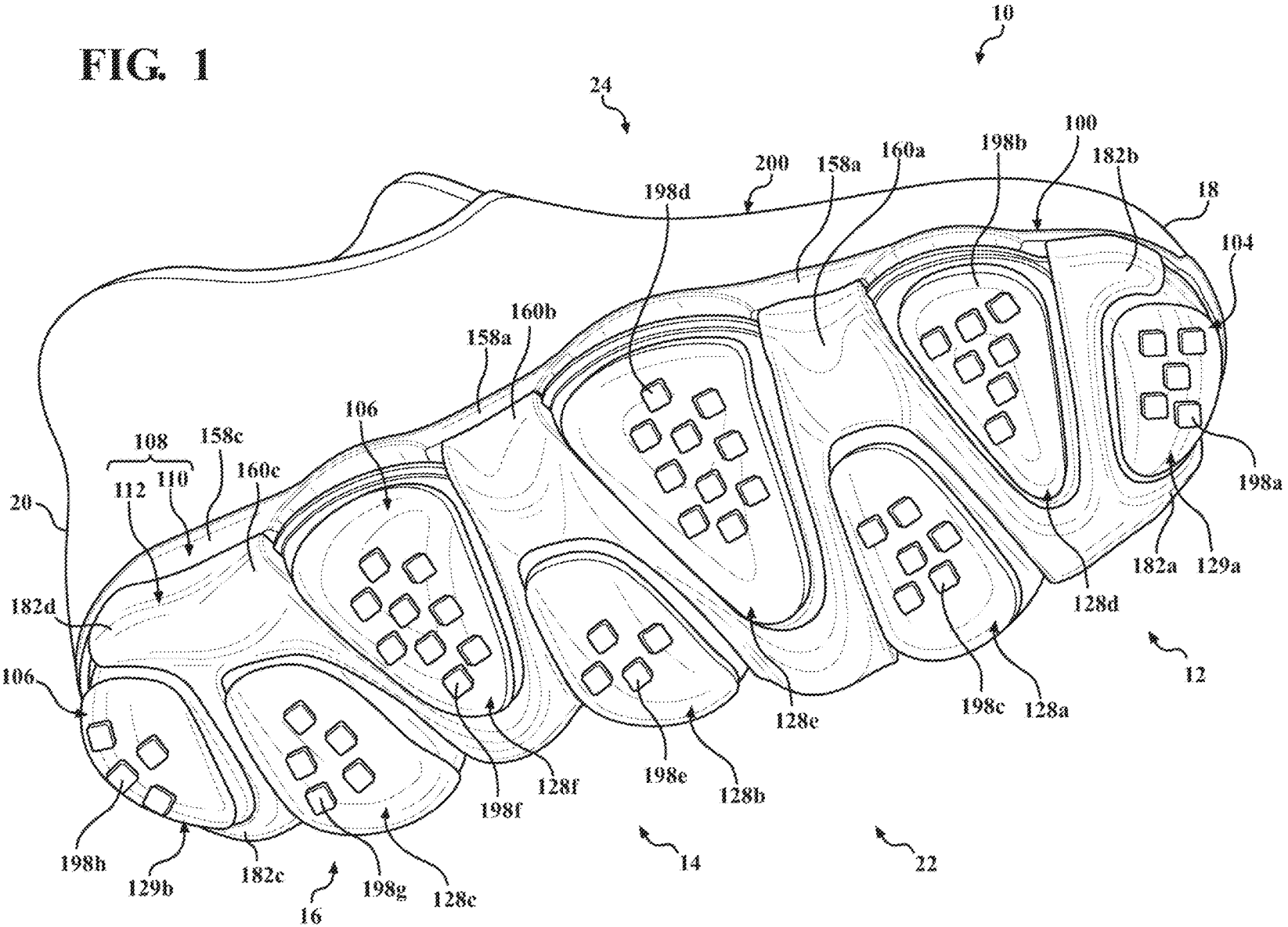
FIG. 1 is a perspective view of an article of footwear including a sole structure in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for article of footwear. The sole structure includes a bladder having a plurality of tapered chambers including (a) a series of first tapered chambers tapering from a first end on a medial side of the bladder to a second end on a lateral side of the bladder, and (b) one or more second tapered chambers tapering from a first end on the lateral side of the bladder to a second end on the medial side of the bladder. Each of the one or more second tapered chambers is interposed between adjacent ones of the first tapered chambers. The sole structure also includes a chassis having a first element disposed on a first side of the bladder and having a plurality of first ribs each disposed between adjacent ones of the first tapered chambers and the second tapered chambers.

Implementations of the disclosure may include one or more of the following optional features. In some implementations, a width of each of the first tapered chambers and the second tapered chambers tapers from the first end to the second end. A thickness of each of the first tapered chambers and the second tapered chambers may taper from the first end to the second end. Adjacent ones of the first tapered chambers and the second tapered chambers may be connected by a web area. Here, the web area may define a series of pockets between adjacent ones of the tapered chambers. A width each of the pockets may be constant from the lateral side to the medial side.

In some examples, each of the first ribs is connected to an adjacent one of the first ribs to form a continuous first ridge. Here, the first ridge may extend around the second end of each of the tapered chambers. The first element may include a top surface forming a footbed of the sole structure and a bottom surface formed on an opposite side of the first element than the top surface, the first ribs extending from the bottom surface. Here, the first element may include a plurality of openings formed through the top surface between adjacent ones of the first ribs. Optionally, each one of the tapered chambers may be exposed through a respective one of the openings.

In some configurations, the chassis includes a second element disposed on an opposite side of the bladder from the first element and including a plurality of second ribs each disposed between adjacent ones of the first tapered chambers and the second tapered chambers. Here, the second ribs may oppose the first ribs across the bladder. Additionally or alternatively, ends of adjacent ones of the second ribs may be connected to each other to form a continuous second ridge. The tapered chambers may be in fluid communication with one another.

Another aspect of the disclosure provides a sole structure for an article of footwear. The sole structure includes a bladder having a plurality of chambers including (a) a series of tapered chambers each extending from a medial side of the bladder to a lateral side of the bladder, and (b) a second chamber extending along at least one of one of the medial side of the bladder and the lateral side of the bladder and connecting each of the tapered chambers. The sole structure also includes a chassis having a plurality of ribs each disposed between adjacent ones of the tapered chambers.

This aspect may include one or more of the following optional features. In some implementations, a width of each of the tapered chambers tapers along a direction extending between the medial side and the lateral side. A thickness of each of the tapered chambers may taper along a direction extending between the medial side and the lateral side. Optionally, adjacent ones of the tapered chambers may be connected by a web area. Here, the web area may define a series of pockets between the adjacent ones of the tapered chambers. A width of each of the pockets may be constant from the lateral side to the medial side.

In some examples, each of the plurality of ribs is connected to an adjacent one of the ribs to form a continuous ridge. Here, the ridge may extend around an end of each of the tapered chambers. The chassis may include a top surface forming a footbed of the sole structure and a bottom surface formed on an opposite side than the top surface, the ribs extending from the bottom surface. The second chamber may include a first segment extending along the medial side, a second segment extending along the lateral side, and a third segment extending from the first segment to the second segment.

Another aspect of the disclosure provides a sole structure for an article of footwear. The sole structure includes a bladder having a plurality of tapered chambers including (a) a series of first tapered chambers tapering from a first end on a medial side of the bladder to a second end on a lateral side of the bladder, and (b) one or more second tapered chambers tapering from a first end on the lateral side of the bladder to a second end on the medial side of the bladder. Each of the one or more second tapered chambers is interposed between adjacent ones of the first tapered chambers. The sole structure also includes a chassis having a plurality of bottom pockets spaced apart from each other so as to define a plurality of first ribs. The plurality of bottom pockets is configured to receive a top portion of the first and second tapered chambers wherein each of the plurality of first ribs is disposed between adjacent ones of the first tapered chambers and the second tapered chambers.

This aspect may include one or more of the following optional features. In some implementations, a width of each of the tapered chambers tapers along a direction extending between the medial side and the lateral side. A thickness of each of the tapered chambers may taper along a direction extending between the medial side and the lateral side. Optionally, adjacent ones of the tapered chambers may be connected by a web area. Here, the web area may define a series of pockets between the adjacent ones of the tapered chambers. A width of each of the pockets may be constant from the lateral side to the medial side.

In some examples, each of the plurality of ribs is connected to an adjacent one of the ribs to form a continuous ridge. Here, the ridge may extend around an end of each of the tapered chambers.

In some examples, the sole structure may further include an outsole. The outsole may include a plurality of fragments. Each of the plurality of fragments are attached to a bottom portion of a corresponding one of the plurality of chambers. In one aspect, a peripheral edge of each of the plurality of fragments is spaced apart from the web area so as to expose a portion of a respective first and second tapered chambers. In another aspect, the chassis includes a lip receiving portion disposed on an end of the chassis, and one of the plurality of fragments includes a lip portion configured to be seated into the lip receiving portion of the chassis.

The details of one or more implementations of the disclosure are set forth in the accompanying drawings and the description below. Other aspects, features, and advantages will be apparent from the description and drawings, and from the claims.

Figure 2:
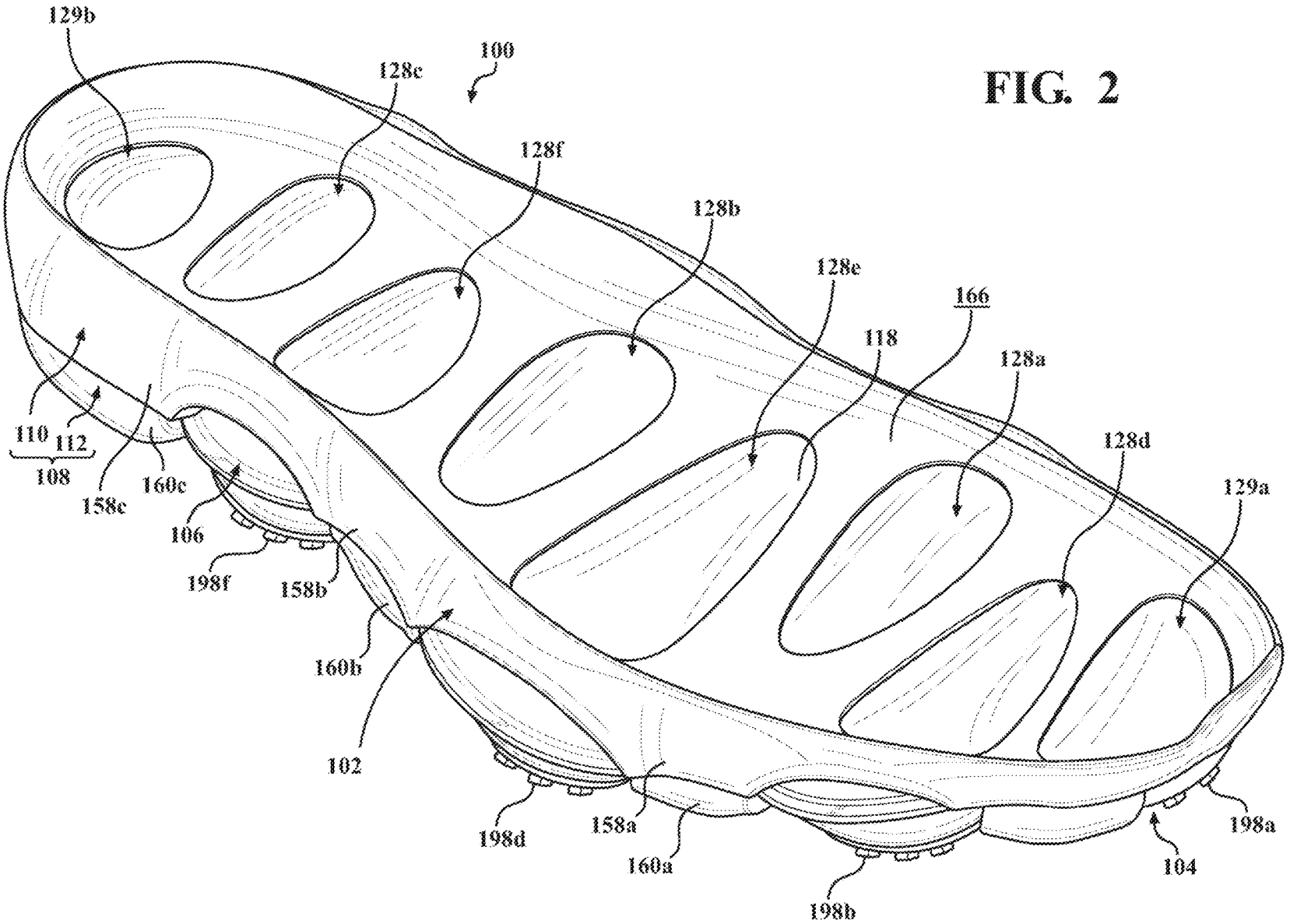
FIG. 2 is a perspective of a sole structure in accordance with the principles of the present disclosure, for use with the article of footwear of FIG. 1.
Figure 3:
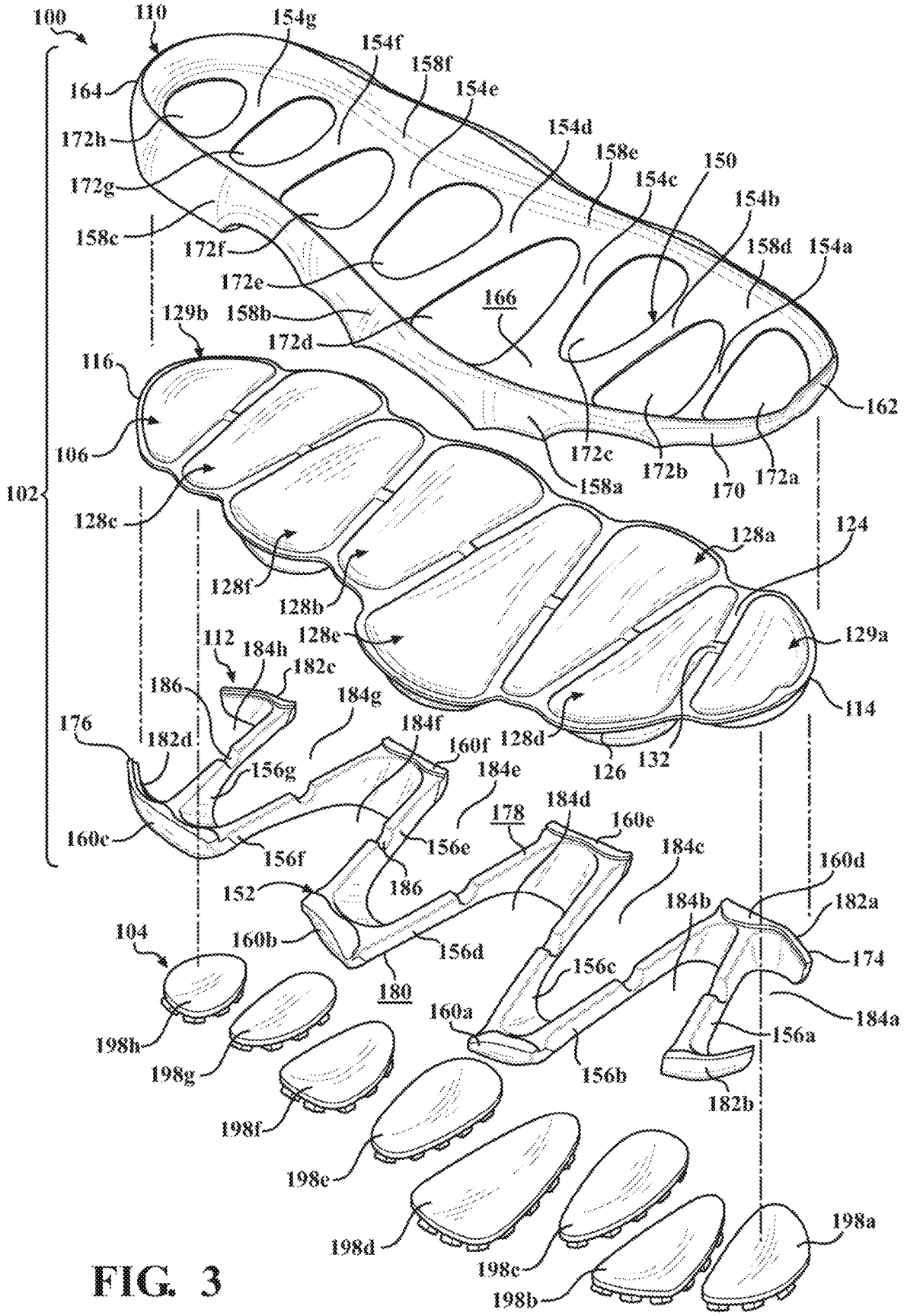
FIG. 3 is an exploded top perspective view of a sole structure in accordance with the principles of the present disclosure, for use with the article of footwear of FIG. 1.

Referring to FIGS. 1-9, an article of footwear 10 includes a sole structure 100 and an upper 200 attached to the sole structure 100. The article of footwear 10 may be divided into one or more regions. The regions may include a forefoot region 12, a mid-foot region 14, and a heel region 16. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis $A_{10}$ of the footwear 10 extends along a length of the footwear 10 from the anterior end 18 to the posterior end 20, and generally divides the footwear 10 into a medial side 22 and a lateral side 24, as shown in FIG. 3. Accordingly, the medial side 22 and the lateral side 24 respectively correspond with opposite sides of the footwear 10 and extend through the regions 12, 14, 16.

Figure 5:
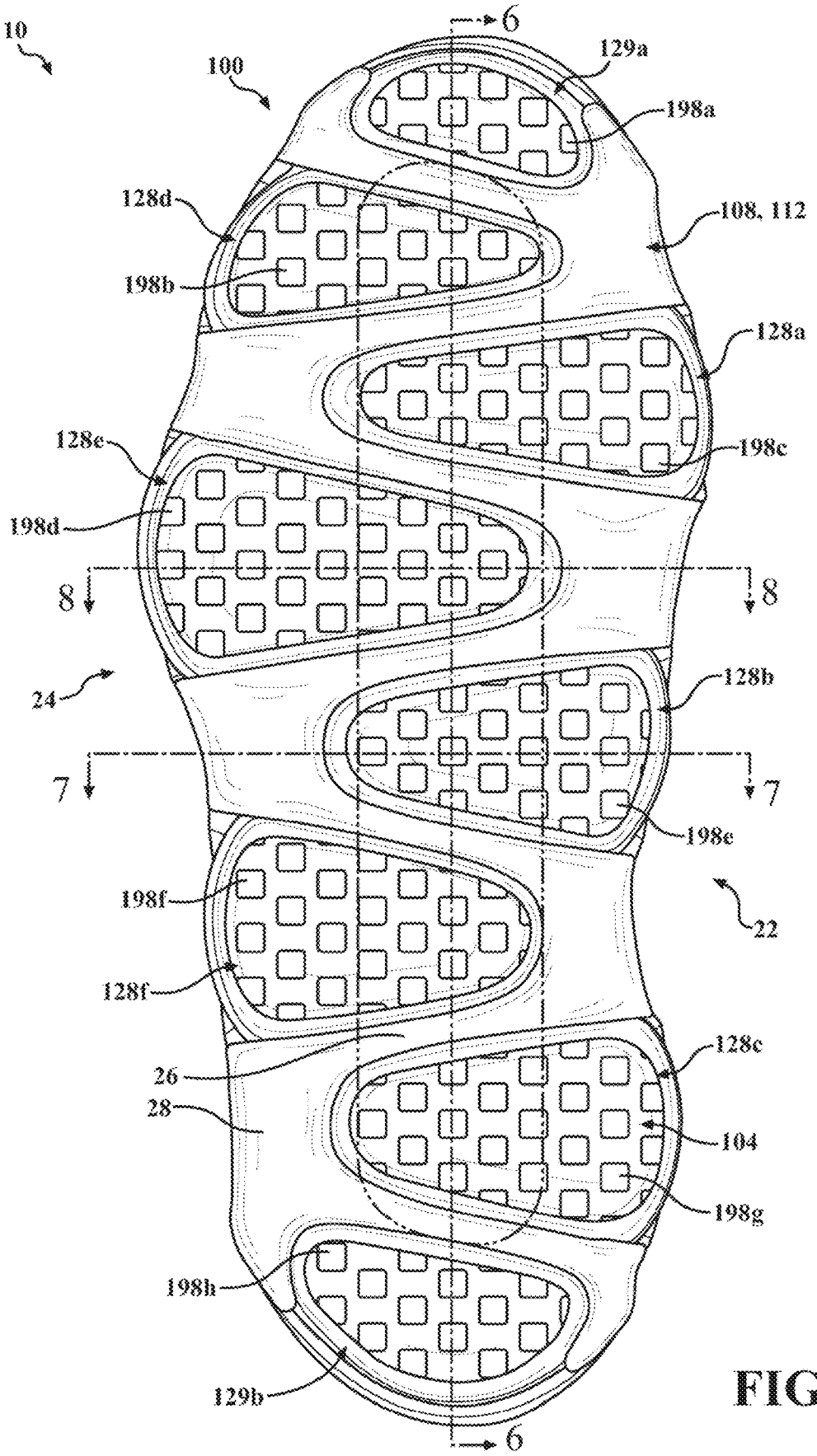
FIG. 5 is a bottom plan view of a sole structure in accordance with the principles of the present disclosure, for use with the article of footwear of FIG. 1.

The article of footwear 10, and more particularly, the sole structure 100, may be further described as including an interior region 26 and a peripheral region 28, as indicated in FIG. 5. The peripheral region 28 is generally described as being a region between the interior region 26 and an outer perimeter of the sole structure 100. Particularly, the peripheral region 28 extends from the forefoot region 12 to the heel region 16 along each of the medial side 22 and the lateral side 24, and wraps around each of the forefoot region 12 and the heel region 16. Thus, the interior region 26 is circumscribed by the peripheral region 28, and extends from the forefoot region 12 to the heel region 16 along a central portion of the sole structure 100.

Figure 4:
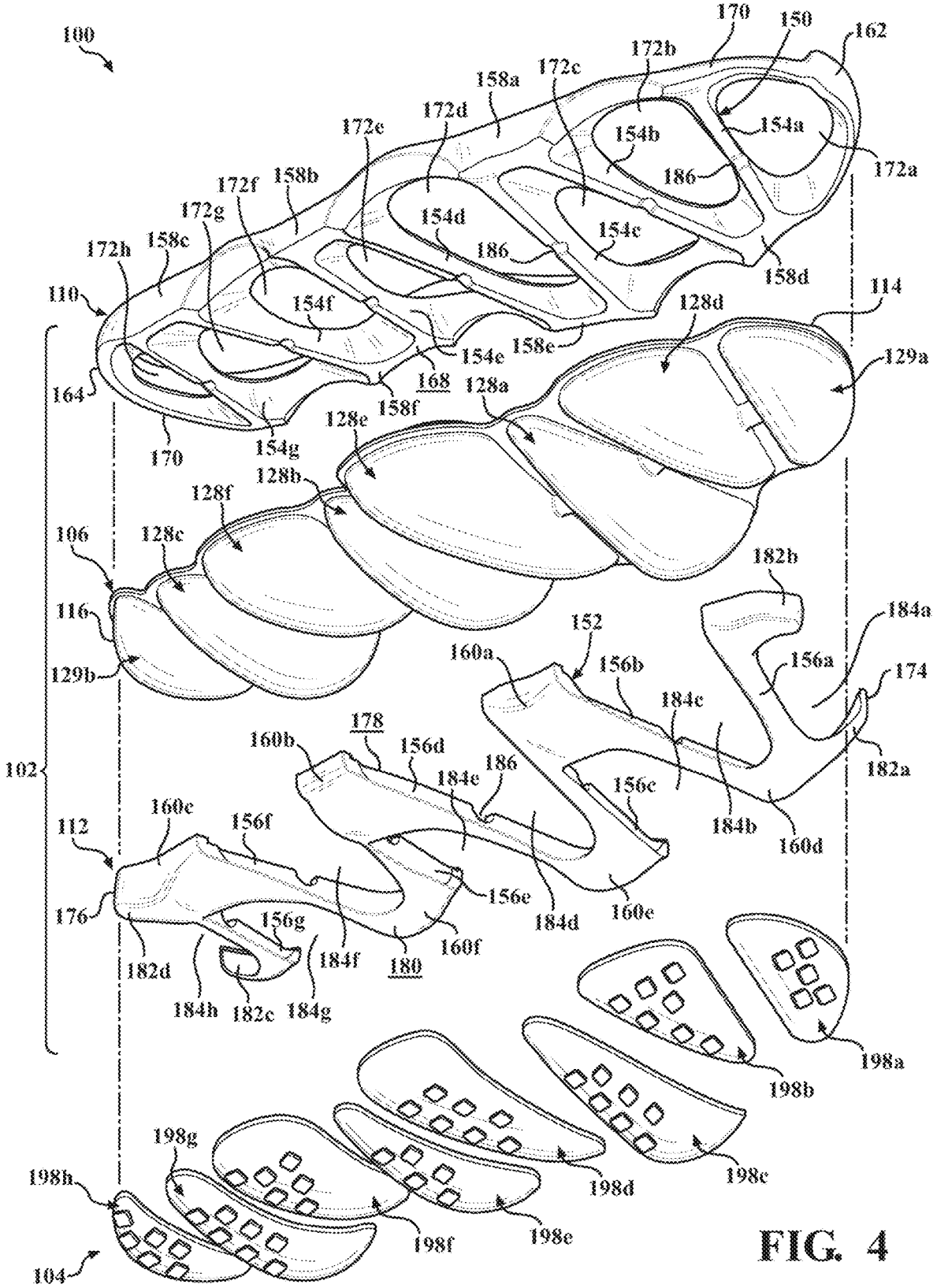
FIG. 4 is an exploded bottom perspective view of a sole structure in accordance with the principles of the present disclosure, for use with the article of footwear of FIG. 1.

With reference to FIGS. 2-4, the sole structure 100 includes a midsole 102 configured to provide cushioning characteristics to the sole structure 100, and an outsole 104 configured to provide a ground-engaging surface of the article of footwear 10. Unlike conventional sole structures, the midsole 102 of the sole structure 100 may be formed compositely and include a plurality of subcomponents for providing desired forms of cushioning and support throughout the sole structure 100. For example, the midsole 102 includes a bladder 106 and a chassis 108, where the chassis 108 is attached to the upper 200 and provides an interface between the upper 200 and the bladder 106. In some examples, the chassis 108 includes a first, upper element 110 disposed on a first side of the bladder 106 and a second, lower element 112 disposed on an opposite, second side of the bladder 106 from the upper element 110. Here, the bladder 106 is partially encapsulated within the chassis 108, between the upper element 110 and the lower element 112, as described in greater detail below.

With reference to FIGS. 3 and 4, a length of the bladder 106 extends from a first end 114 in the forefoot region 12 to a second end 116 in the heel region 16. The bladder 106 may be further described as including a top surface or side 118 and a bottom surface or side 120 formed on an opposite side of the bladder 106 from the top side 118. As discussed in greater detail below, thicknesses $T_{106}$ of the bladder 106, or of elements of the bladder 106, are defined by a distance from the top side 118 to the bottom side 120.

Figure 6:
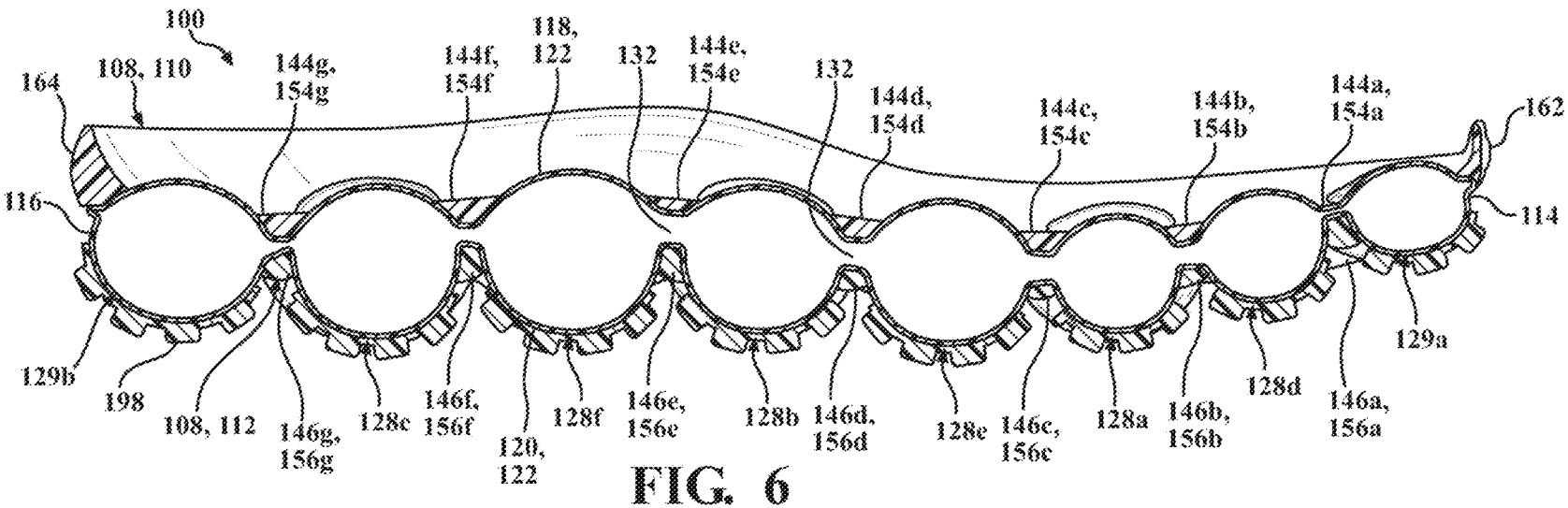
FIG. 6 is a cross-sectional view of the sole structure of FIG. 5, taken along Line 6-6 of FIG. 5.
Figure 7:
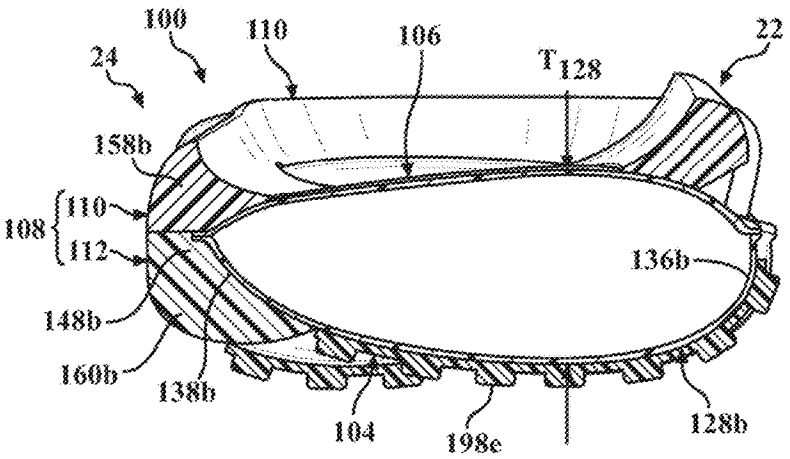
FIG. 7 is a cross-sectional view of the sole structure of FIG. 5, taken along Line 7-7 of FIG. 5.
Figure 8:
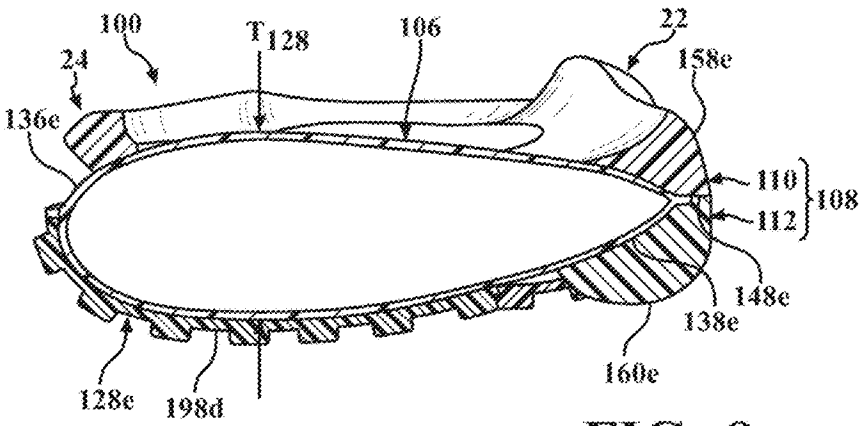
FIG. 8 is a cross-sectional view of the sole structure of FIG. 5, taken along Line 8-8 of FIG. 5.

As shown in the cross-sectional views of FIGS. 6-8, the bladder 106 may be formed by an opposing pair of barrier layers 122, which can be joined to each other at discrete locations to define an overall shape of the bladder 106. Alternatively, the bladder 106 can be produced from any suitable combination of one or more barrier layers. As used herein, the term "barrier layer" (e.g., barrier layers 122) encompasses both monolayer and multilayer films. In some embodiments, one or both of the barrier layers 122 are each produced (e.g., thermoformed or blow molded) from a monolayer film (a single layer). In other embodiments, one or both of the barrier layers 122 are each produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 122 can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 122 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-dii so cyanate (NDI), 1,5-tetrahydronaphthal ene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including hydrogenated MDI (HMDI), TDI, MDI, hydrogenated (H12) aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials, as well as with the TPU copolymers described herein and optionally including combinations of polyimides and crystalline polymers, are also suitable.

The barrier layers 122 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entireties. In embodiments where the barrier layers 122 include two or more sublayers, examples of suitable multilayer films include microlayer films, such as those disclosed in Bonk et al., U.S. Pat. No. 6,582,786, which is incorporated by reference in its entirety. In further embodiments, the barrier layers 122 may each independently include alternating sublayers of one or more TPU copolymer materials and one or more EVOH copolymer materials, where the total number of sublayers in each of the barrier layers 122 includes at least four (4) sublayers, at least ten (10) sublayers, at least twenty (20) sublayers, at least forty (40) sublayers, and/or at least sixty (60) sublayers.

The bladder 106 can be produced from the barrier layers 122 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 122 can be produced by co-extrusion followed by vacuum thermoforming to form the profile of the bladder 106, which can optionally include one or more valves (e.g., one way valves) that allows the bladder 106 to be filled with the fluid (e.g., gas).

The bladder 106 desirably has a low gas transmission rate to preserve its retained gas pressure. In some embodiments, the bladder 106 has a gas transmission rate for nitrogen gas that is at least about ten (10) times lower than a nitrogen gas transmission rate for a butyl rubber layer of substantially the same dimensions. In an aspect, bladder 106 has a nitrogen gas transmission rate of 15 cubic-centimeter/square-meter•atmosphere•day ($cm^3/m^2$•atm•day) or less for an average film thickness of 500 micrometers (based on thicknesses of barrier layers 122). In further aspects, the transmission rate is 10 $cm^3/m^2$•atm•day or less, 5 $cm^3/m^2$•atm•day or less, or 1 $cm^3/m^2$•atm•day or less.

In the shown embodiment, the barrier layers 122 include a first, upper barrier layer 122 forming the top side 118 of the bladder 106, and a second, lower barrier layer 122 forming the bottom side 120 of the bladder 106. In the illustrated example, interior, opposing surfaces (i.e. facing each other) of the barrier layers 122 are joined together at discrete locations to form a web area 124 and a peripheral seam 126. The peripheral seam 126 extends around the outer periphery of the bladder 106 and defines an outer peripheral profile of the bladder 106.

As shown in FIGS. 6-9, the upper and lower barrier layers 122 are spaced apart from each other between the web area 124 and the peripheral seam 126 to define a plurality of chambers **128*a*-128*f*, 129*a*-129*b* and a conduit 132 each forming a respective portion of an interior void 134 of the bladder 106. The chambers 128*a*-128*f*, 129*a*-129*b* are arranged in series from the first end 114 of the bladder 106 to the second end 116 of the bladder 106. Here, the chambers 128*a*-128*f*, 129*a*-129*b* include a plurality of tapered chambers 128*a*-128*f* arranged in series between a pair of end chambers 129*a*, 129*b* disposed at opposite ends 114, 116 of the bladder 106**.

Figure 9:
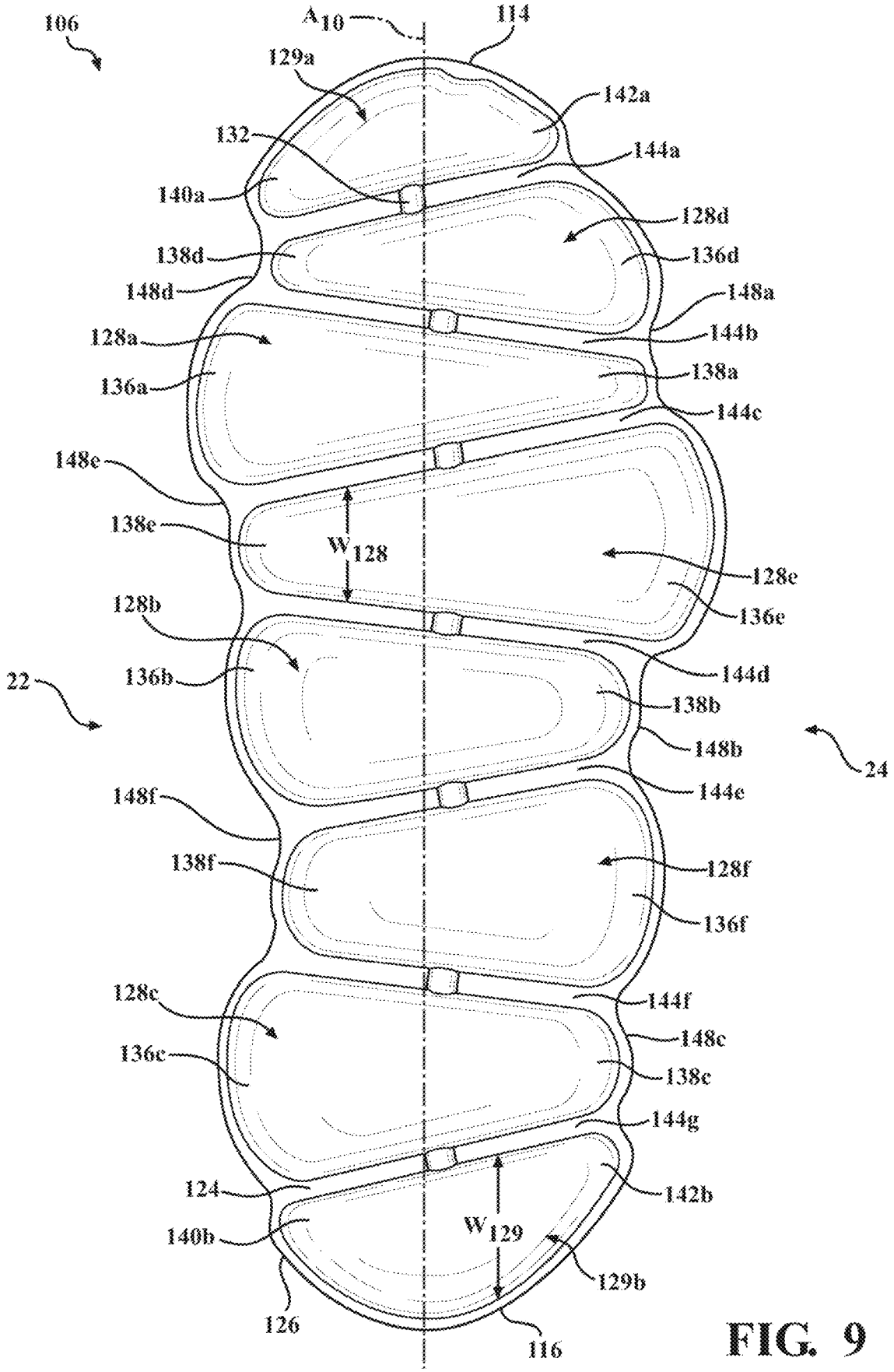
FIG. 9 is a top plan view of a bladder in accordance with the principles of the present disclosure, for use with the article of footwear of FIG. 1.
Figure 10:
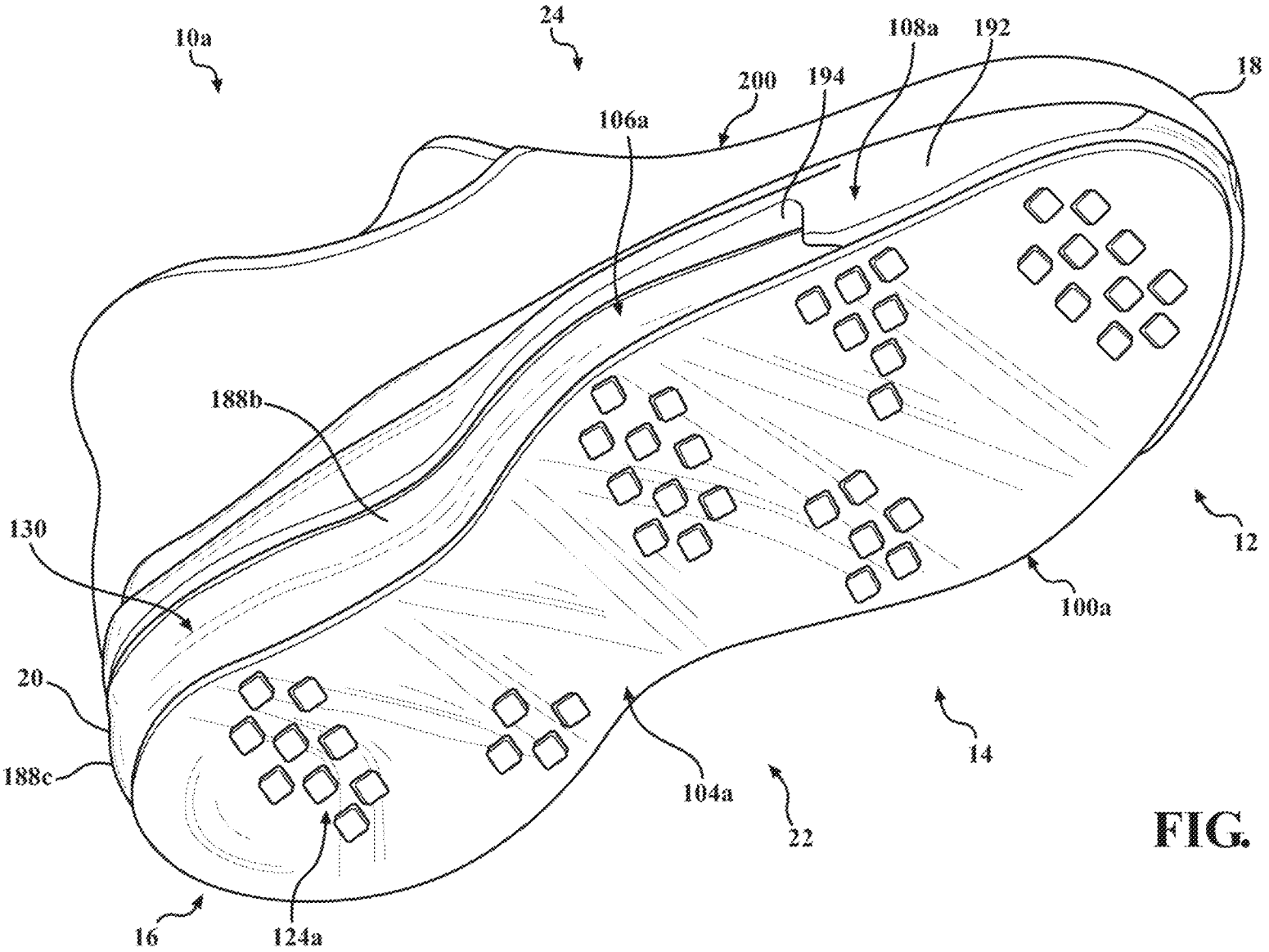
FIG. 10 is a perspective view of an article of footwear including a sole structure in accordance with the principles of the present disclosure.

Turning now to FIG. 9, the bladder 106 includes a plurality of the tapered chambers **128*a*-128*f* each having a length extending substantially perpendicular to the longitudinal axis $A_{10}$, from a first end 136*a*-136*f* on one of the medial side 22 or the lateral side 24 of the bladder 106 to a second end 138*a*-138*f* on the other of the medial side 22 or the lateral side 24 of the bladder 106. Here, widths $W_{128}$ of each of the chambers 128*a*-128*f* are measured along a direction of the longitudinal axis $A_{10}$ and are defined by adjacent segments of the web area 124. With reference to FIGS. 6-8, thicknesses $T_{128}$ of the tapered chambers 128*a*-**

128*f* correspond to the thickness $T_{106}$ of the bladder 106 measured at each of the respective tapered chambers 128*a*-128*f* As discussed in greater detail below, the widths $W_{128}$ and thicknesses $T_{128}$ of each of the tapered chambers 128*a*-128*f* taper across the width of the bladder 106 from the first end 136*a*-136*f* to the second end 138*a*-138*f*. Accordingly, each of the tapered chambers 128*a*-128*f* may also be described as having tapering cross-sections along the lengthwise direction.

With continued reference to FIG. 9, the tapered chambers 128*a*-128*f* may be described as including a series of first tapered chambers 128*a*-128*c* that taper in a first direction and a series of second tapered chambers 128*d*-128*f* that taper in an opposite second direction. As shown, the first tapered chambers 128*a*-128*c* are alternatingly arranged with the second tapered chambers 128*d*-128*f* along the length of the bladder 106, such that one of the second tapered chambers 128*d*-128*f* is interposed between consecutive ones of the first tapered chambers 128*a*-128*c* and vice versa. Accordingly, the first tapered chambers 128*a*-128*c* and the second tapered chambers 128*d*-128*f* are arranged in an alternating series from the forefoot region 12 to the heel region 16.

The first tapered chambers 128*a*-128*c* extend from respective ones of the first ends 136*a*-136*c* on the medial side 22 of the bladder 106 to respective ones of the second ends 138*a*-138*c* on the lateral side 24 of the bladder 106. The first tapered chambers 128*a*-128*c* taper in the direction from the first end 136*a*-136*c* to the second end 138*a*-138*c*, such that a cross-sectional area of the interior void 134 is greater at the medial side 22 than at the lateral side 24. The second tapered chambers 128*d*-128*f* extend from respective ones of the first ends 136*d*-136*f* on the lateral side 24 of the bladder 106 to respective ones of the second ends 138*d*-138*f* on the medial side 22 of the bladder 106. The second tapered chambers 128*d*-128*f* taper in the direction from the first end 136*d*-136*f* to the second end 138*d*-138*f*, such that a cross-sectional area of the interior void 134 is greater at the lateral side 24 than at the medial side 22.

In some examples, the widths $W_{128}$ of each of the tapered chambers 128*a*-128*f* taper constantly and continuously from the first end 136*a*-136*f* to the second end 138*a*-138*f* As illustrated in the example of FIGS. 7 and 8, thicknesses of each of the tapered chambers 128*a*-128*f* also taper along the direction from the first end 136*a*-136*f* to the second end 138*a*-138*fc*. Particularly, each of the tapered chambers 128*a*-128*f* tapers from a maximum thickness adjacent to the first end 136*a*-136*f* to a minimum thickness adjacent to the second end 138*a*-138*f*

As shown, the end chambers 129*a*, 129*b* include an anterior end chamber 129*a* disposed at the anterior end 18 and a posterior end chamber 129*b* disposed at the posterior end 20. Lengths of each of the end chambers 129*a*, 129*b* extends from a first end 140*a*, 140*b* on the medial side 22 to a second end 142*a*, 142*b* on the lateral side 24. Unlike the tapered chambers 128*a*-128*f*, which have widths $W_{128}$ defined by segments of the web area 124, each of the end chambers 129*a*, 129*b* has a width $W_{129}$ measured from a portion of the web area 124 to a portion of the peripheral seam 126 extending around one of the ends 114, 116 of the bladder 106. As such, the widths $W_{129}$ of the end chambers 129*a*, 129*b* taper from a central portion (i.e., adjacent to the longitudinal axis $A_{10}$) towards each of the medial and lateral sides 22, 24.

With reference to FIG. 6, opposing ones of the chambers 128*a*-128*f*, 129*a*-129*b* are separated from each other by segments of the web area 124, such that opposing pairs of pockets or spaces 144*a*-144*g*, 146*a*-146*g* are formed on opposite sides 118, 120 of the bladder 106 between adjacent ones of the chambers 128*a*-128*f*, 129*a*-129*b*. In other words, the bladder 106 includes a series of upper pockets 144*a*-144*g* formed by the web area 124 and adjacent chambers 128*a*-128*f*, 129*a*-129*b* on the top side 118 of the bladder 106, and a series of lower pockets 146*a*-146*g* formed by the web area 124 and adjacent chambers 128*a*-128*f*, 129*a*-129*b* on the bottom side 120 of the bladder 106.

In addition to the pockets 144*a*-144*g*, 146*a*-146*g* formed on the top and bottom sides 118, 120 of the bladder 106, the outer periphery of the bladder 106 may define a plurality of indentations or sockets 148*a*-148*f* adjacent to the second ends 138*a*-138*f* of each of the tapered chambers 128*a*-128*f* As shown, consecutive ones of the tapered chambers 128*a*-128*f* are laterally staggered, such that the first ends 136*a*-136*c* of the first tapered chambers 128*a*-128*c* are extended outwardly relative to the second ends 138*d*-138*f* of the second tapered chambers 128*d*-128*f* along the medial side 22, and the first ends 136*d*-136*f* of the second tapered chambers 128*d*-128*f* are extended outwardly relative to the second ends 138*a*-138*c* of the first tapered chambers 128*a*-128*c* along the lateral side 24. Accordingly, the sockets 148*a*-148*f* are defined by the second ends 138*a*-138*f* and consecutive ones of the first ends 136*a*-136*f*. As discussed in greater detail below, the sockets 148*a*-148*f* are configured to receive a portion of the chassis 108, such that the chassis 108 extends around the second ends 138*a*-138*f* of each of the chambers 128*a*-128*f*

As shown in FIG. 9, the bladder 106 further includes the conduit 132 that provides fluid communication between two or more of the chambers 128*a*-128*f*, 129*a*-129*b*. In the illustrated example, the conduit 132 is formed in the web area 124 along the interior region 26 of the bladder and fluidly couples all of the chambers 128*a*-128*f*, 129*a*-129*b*. Accordingly, a fluid pressure within the bladder 106 will be the same among all of the chambers 128*a*-128*f*, 129*a*-129*b*. In some examples, one or more of the chambers 128*a*-128*f*, 129*a*-129*b* may be fluidly isolated from one or more of the other chambers 128*a*-128*f*, 129*a*-129*b*.

With continued reference to FIGS. 2-4, the upper and lower elements 110, 112 of the chassis 108 are configured to interface with the bladder 106 to provide a unitary midsole 102. One or more of the subcomponents 110, 112 of the chassis 108 are at least partially formed of a resilient polymeric material, such as foam or rubber, to impart properties of cushioning, responsiveness, and energy distribution to the foot of the wearer. Example resilient polymeric materials for the chassis may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Examples of suitable polyurethanes include those discussed above for barrier layers 122. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a BANBURY® mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Generally, each of the upper and lower elements 110, 112 includes a respective ridge 150, 152 having a series of ribs 154*a*-154*g*, 156*a*-156*g* configured to mate with one of the pockets 144*a*-144*g*, 146*a*-146*g* of the bladder 106. The ridges 150, 152 are formed by connecting consecutive ones of the ribs 154*a*-154*g*, 156*a*-156*g* to each other at a node 158*a*-158*f*, 160*a*-160*f* on one of the medial side 22 and the lateral side 24. Here, the nodes 158*a*-158*f*, 160*a*-160*f* form protrusions that are received within the sockets 148*a*-148*f* of the bladder 106, as shown in FIGS. 7 and 8.

With particular reference to FIGS. 3 and 4, the upper element 110 of the chassis 108 extends from a first end 162 at the anterior end 18 of the sole structure 100 to a second end 164 at the posterior end 20 of the sole structure 100. The upper element 110 further includes a top surface 166 defining a portion of a footbed, and a bottom surface 168 that is formed on the opposite side of the upper element 110 than the top surface 166 and configured to interface with the top side 118 of the bladder 106. The upper element 110 may further include a peripheral wall 170 extending continuously around an outer periphery of the upper element 110.

As discussed above, the upper element 110 forms an upper ridge 150 having a plurality of elongate upper ribs 154*a*-154*g* joined to each other at the medial side 22 and the lateral side 24 by respective nodes 158*a*-158*f* Here, each of the upper ribs 154*a*-154*g* corresponds to one of the upper pockets 144*a*-144*g* formed in the bladder 106, such that when the upper element 110 is assembled with the bladder 106, one of the upper ribs 154*a*-154*g* is received within one of the upper pockets 144*a*-144*g*. Accordingly, consecutive ones of the upper ribs 154*a*-154*g* converge with each other at the second ends 138*a*-138*f* of each of the tapered chambers 128*a*-128*f*

Ends of the upper ribs 154*a*-154*g* disposed at the second ends 138*a*-138*f* of the tapered chambers 128*a*-128*f* are connected to each other by one of the upper nodes 158*a*-158*f*. Accordingly, like the second ends 138*a*-138*f*, consecutive ones of the upper nodes 158*a*-158*f* are alternatingly arranged along the medial and lateral sides 22, 24 of the upper element 110. In the illustrated example, the ends of the upper ribs 154*a*-154*g* formed adjacent to the first ends 136*a*-136*f* of the tapered chambers are connected to each other by respective segments of the peripheral wall 170. Accordingly, the ribs 154*a*-154*g* of the upper element 110 are connected along both sides 22, 24 of the upper element 110.

With continued reference to FIGS. 3 and 4, the upper ridge 150 and the peripheral wall 170 of the upper element 110 cooperate to define a plurality of upper openings 172*a*-

172*h* extending through a thickness of the upper element 110 (i.e., from the top surface 166 to the bottom surface 168) between adjacent ones of the upper ribs 154*a*-154*g*. Here, a shape and position of each of the upper openings 172*a*-172*h* corresponds to one of the chambers 128*a*-128*f*, 129*a*-129*b*, such that when the midsole 102 is assembled, the portion of the top side 118 of the bladder 106 formed by each of the chambers 128*a*-128*f*, 129*a*-129*b* is received by and exposed through the corresponding upper opening 172*a*-172*h*. As such, exposed portions of the top side 118 cooperate with the top surface 166 to form the footbed of the sole structure 100. As shown in FIGS. 6-8, in some examples, one or more of the chambers 128*a*-128*f*, 129*a*-129*b* may extend through a respective one of the upper openings 172*a*-172*h* such that the top side 118 of the bladder 106 protrudes above the top surface 166 of the upper element 110.

The lower element 112 of the chassis 108 extends from a first end 174 at the anterior end 18 of the sole structure 100 to a second end 176 at the posterior end 20 of the sole structure 100. The lower element 112 further includes a top surface 178 configured to interface with the bottom side 120 of the bladder 106, and a bottom surface 180 formed on an opposite side of the lower element 112 than the top surface 178 and defining a portion of a ground-engaging surface of the sole structure 100.

Like the upper element 110, the lower element 112 forms a lower ridge 152 configured to oppose the upper ridge 150 across the web area 124 of the bladder 106. Accordingly, the lower ridge 152 includes a plurality of elongate lower ribs 156*a*-156*g* joined to each other at the medial side 22 and the lateral side 24 by respective nodes 160*a*-160*f* Here, each of the lower ribs 156*a*-156*g* corresponds to one of the lower pockets 146*a*-146*g* formed in the bladder 106, such that when the lower element 112 is assembled with the bladder 106, one of the lower ribs 156*a*-156*g* is received within one of the lower pockets 146*a*-146*g*. Accordingly, consecutive ones of the lower ribs 156*a*-156*f* converge with each other at the second ends 138*a*-138*f* of each of the tapered chambers 128*a*-128*f*.

Ends of the lower ribs 156*a*-156*g* disposed at the second ends 138*a*-138*f* of the tapered chambers 128*a*-128*f* are connected to each other by one of the lower nodes 160*a*-160*f* Thus, as illustrated in FIGS. 2, 7, and 8, the lower nodes 160*a*-160*f* extend around the second ends 138*a*-138*f* of the tapered chambers 128*a*-128*f* and are joined to the upper nodes 158*a*-158*f* along the medial and lateral sides 22, 24. As shown in the examples FIGS. 7 and 8, the second ends 138*a*-138*f* may be at least partially encapsulated between the upper and lower nodes 158*a*-158*f*, 160*a*-160*f*. Here, the upper and lower nodes 158*a*-158*f*, 160*a*-160*f* cooperate to define alternating support columns along the medial and lateral sides 22, 24 of the sole structure. In the illustrated example, the ends of the lower ribs 156*a*-156*g* formed adjacent to the first ends 136*a*-136*f* of the tapered chambers 128*a*-128*f* are disconnected from each other. Optionally, the lower element 110 may include protrusions 182*a*-182*d* formed at the first and second ends 174, 176, which are configured to partially surround each of the end chambers 129*a*, 129*b*.

With reference to FIGS. 4 and 5, the lower ribs 156*a*-156*g* and lower nodes 160*a*-160*f* of the lower element 112 cooperate to define a plurality of lower openings 184*a*-184*h* extending through a thickness of the lower element 112 (i.e., from the top surface 178 to the bottom surface 180) between adjacent ones of the lower ribs 156*a*-156*g*. Here, a shape and position of each of the lower openings 184*a*-184*h* corresponds to one of the chambers 128*a*-128*f*, 129*a*-129*b*, such that when the midsole 102 is assembled, the portion of the bottom side 120 of the bladder 106 formed by each of the chambers 128*a*-128*f*, 129*a*-129*b* is exposed through the corresponding lower opening 184*a*-184*h*. As such, exposed portions of the bottom side 120 cooperate with the bottom surface 180 to define a profile of the ground-engaging surface of the sole structure 100. As shown in FIGS. 6-8, in some examples, one or more of the chambers 128*a*-128*f*, 129*a*-129*b* may extend through a respective one of the lower openings 184*a*-184*h* such that the bottom side 120 of the bladder 106 protrudes below the bottom surface 168 of the lower element 112.

In the illustrated example, the ridge 150 fully extends into the upper pockets 144*a*-144*g* when the midsole 102 is assembled. Thus, as shown in FIG. 6, a portion of the bottom surface 168 formed by the ridge 150 contacts the web area 124 to fill the upper pockets 144*a*-144*g*. Likewise, the lower ribs 156*a*-156*g* are configured to be disposed against the web area 124 on the bottom side 120 when the midsole 102 is assembled. With reference to FIGS. 3 and 4, each of the upper and lower ribs 154*a*-154*g*, 156*a*-156*g* may be formed with a notch 186 configured to receive the conduit 132, thereby allowing the upper and lower ridges 150, 152 to fully mate with the bladder 106.

In some examples, the outsole 104 extends over the midsole 102 to provide increased durability and resiliency. In the illustrated example, the outsole 104 is provided as a plurality of fragments 198*a*-198*h* that are overmolded onto the bladder 106 to provide increased durability to the exposed portions of the lower barrier layer 122 of the bladder 106. Accordingly, the outsole 104 is formed of a different material than the bladder 106, and includes at least one of a different thickness, a different hardness, and a different abrasion resistance than the lower barrier layer 122. In some examples, the outsole 104 may be formed integrally with the lower barrier layer 122 of the bladder 106 using an overmolding process. In other examples the outsole 104 may be formed separately from the lower barrier layer 122 of the bladder 106 and may be adhesively bonded to the lower barrier layer 122.

Referring again to FIG. 1, the upper 200 is attached to the sole structure 100 and includes interior surfaces that define an interior void configured to receive and secure a foot for support on sole structure 100. The upper 200 may be formed from one or more materials that are stitched or adhesively bonded together to form the interior void. Suitable materials of the upper 200 may include, but are not limited to, mesh, textiles, foam, leather, and synthetic leather. The materials may be selected and located to impart properties of durability, air-permeability, wear-resistance, flexibility, and comfort.

Referring now to FIGS. 10-19, an article of footwear 10*a* is provided and includes a sole structure 100*a* and the upper 200 attached to the sole structure 100*a*. In view of the substantial similarity in structure and function of the components associated with the article of footwear 10*a* with respect to the article of footwear 10, like reference numerals are used hereinafter and in the drawings to identify like components while like reference numerals containing letter extensions are used to identify those components that have been modified.

Figure 12:
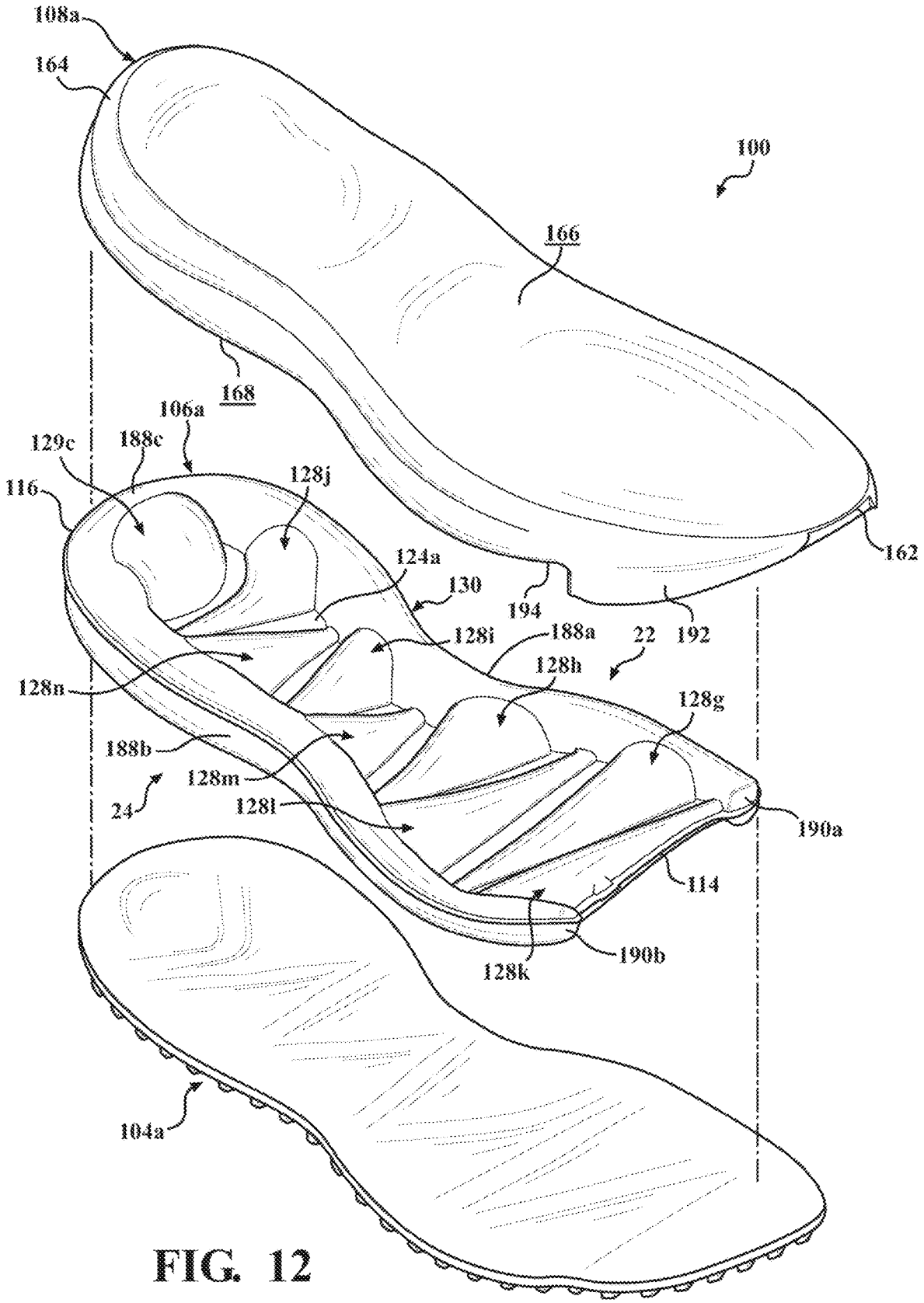
FIG. 12 is an exploded top perspective view of a sole structure in accordance with the principles of the present disclosure, for use with the article of footwear of FIG. 10.
Figure 13:
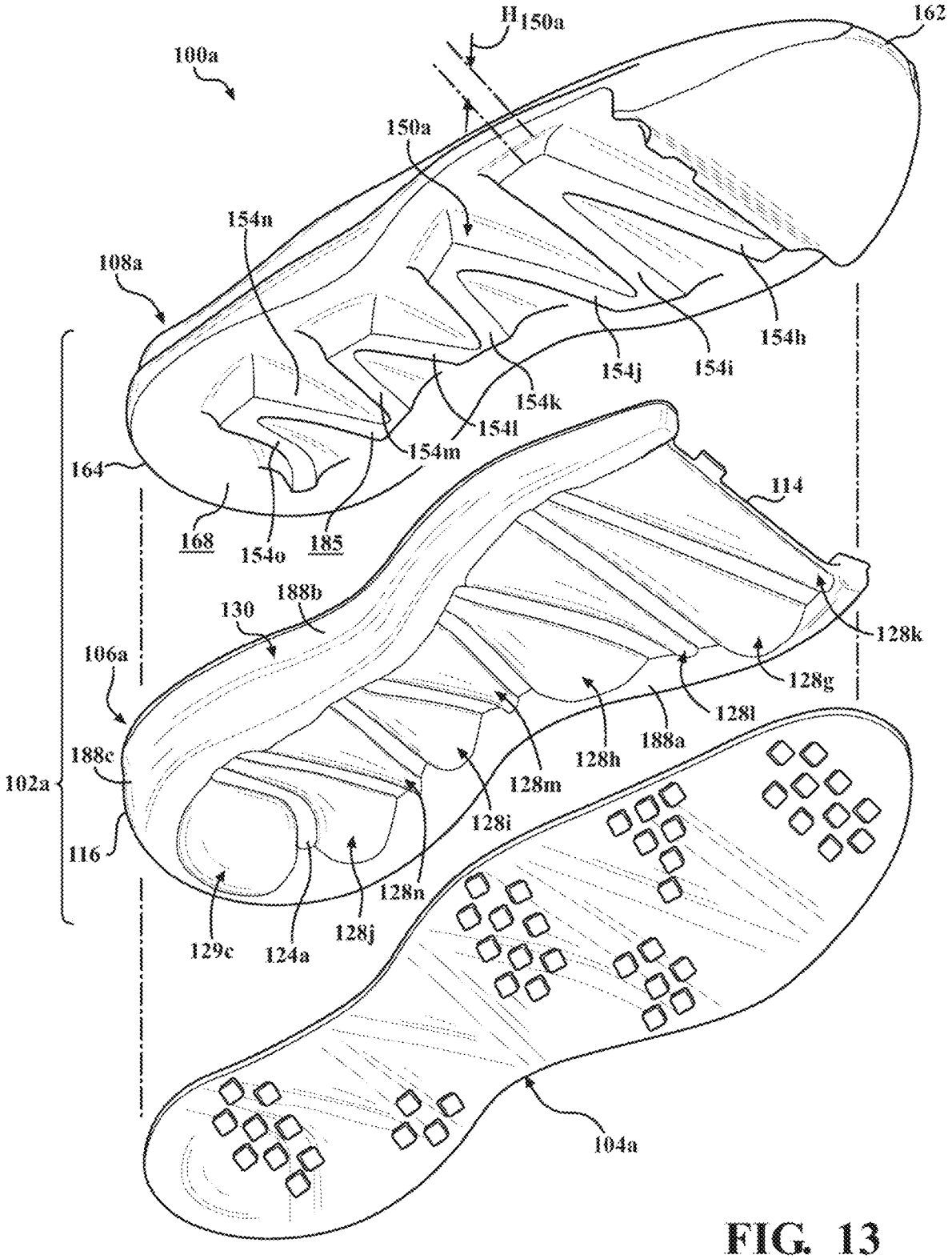
FIG. 13 is an exploded bottom perspective view of a sole structure in accordance with the principles of the present disclosure, for use with the article of footwear of FIG. 10.
Figure 14:
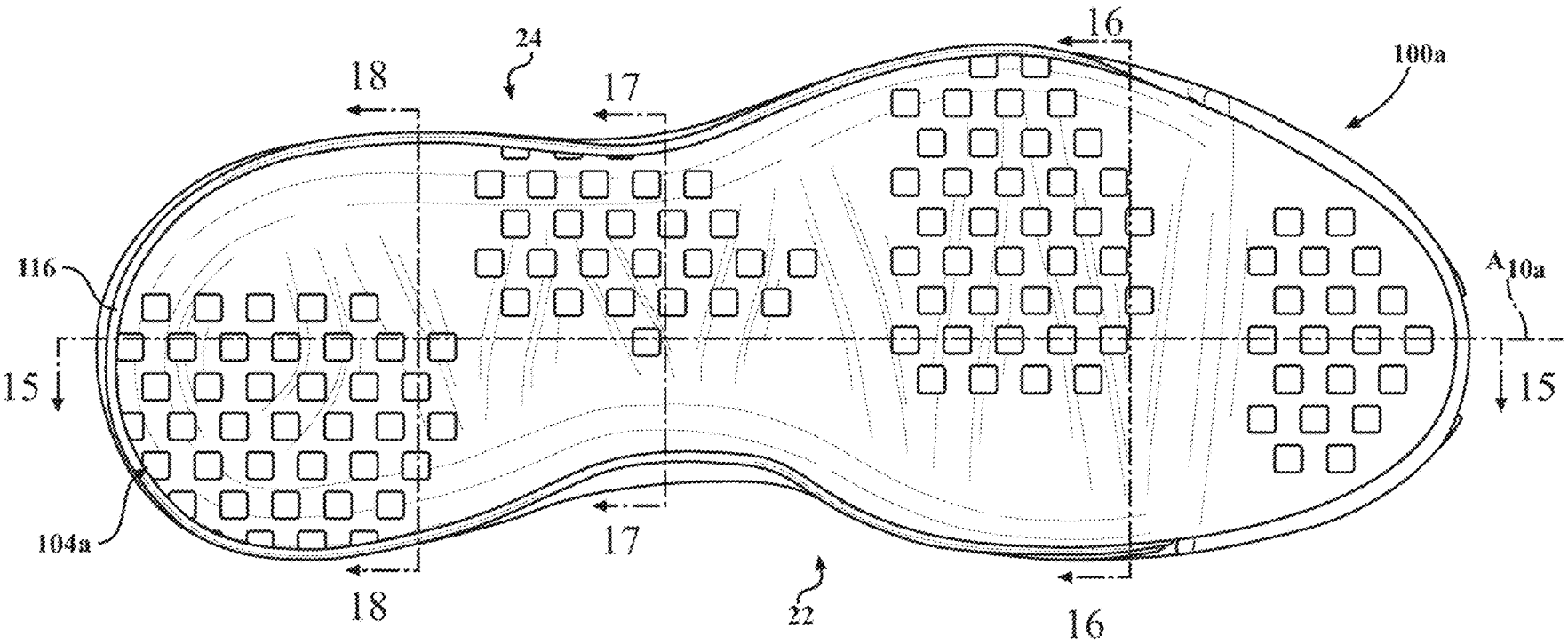
FIG. 14 is a bottom plan view of a sole structure in accordance with the principles of the present disclosure, for use with the article of footwear of FIG. 10.

With reference to FIGS. 12 and 13, the sole structure 100*a* includes a midsole 102*a* configured to provide cushioning characteristics to the sole structure 100*a*, and an outsole 104*a* configured to provide a ground-engaging surface of the article of footwear 10*a*. The midsole 102*a* includes a bladder 106*a* and a chassis 108*a*, where the chassis 108*a* is attached to the upper 200 and provides an interface between the upper 200 and the bladder 106*a*. Unlike the previous example, where the chassis 108 included upper and lower elements 110, 112, the chassis 108*a* of the present example is formed of a single upper component 108*a* disposed between the bladder 106*a* and the upper.

With continued reference to FIGS. 12 and 13, a length of the bladder 106*a* extends from the first end 114 in the forefoot region 12 to the second end 116 in the heel region 16. The bladder 106*a* may be further described as including the top surface or side 118 and the bottom surface or side 120 formed on an opposite side of the bladder 106*a* from the top side 118. As discussed in greater detail below, thicknesses $T_{106a}$ of the bladder 106*a*, or of elements of the bladder 106*a*, are defined by a distance from the top side 118 to the bottom side 120.

As shown in the cross-sectional views of FIGS. 15-18, the bladder 106*a* may be formed by an opposing pair of the barrier layers 122, which can be joined to each other at discrete locations to define an overall shape of the bladder 106*a*. Alternatively, the bladder 106*a* can be produced from any suitable combination of one or more barrier layers. In the shown embodiment, the barrier layers 122 include a first, upper barrier layer 122 forming the top side 118 of the bladder 106*a*, and a second, lower barrier layer 122 forming the bottom side 120 of the bladder 106*a*. In the illustrated example, interior, opposing surfaces (i.e. facing each other) of the barrier layers 122 are joined together at discrete locations to form a web area 124*a* and a peripheral seam 126*a*. The peripheral seam 126*a* extends around the outer periphery of the bladder 106*a* and defines an outer peripheral profile of the bladder 106*a*.

As shown in FIGS. 15-18, the upper and lower barrier layers 122 are spaced apart from each other between the web area 124*a* and the peripheral seam 126*a* to define a plurality of interior chambers 128*g*-128*n*, 129*c* and a peripheral chamber 130 each forming a respective portion of an interior void 134 of the bladder 106*a*. The interior chambers 128*g*-128*n*, 129*c* are arranged in series from the forefoot region 12 of the bladder 106*a* to the second end 116 of the bladder 106*a*. Here, the interior chambers 128*g*-128*n*, 129*c* include a plurality of tapered chambers 128*g*-128*n* arranged in series from the forefoot region 12 to the heel region 16, and an end chamber 129*c* disposed at the second end 116 of the bladder 106*a*.

Figure 17:
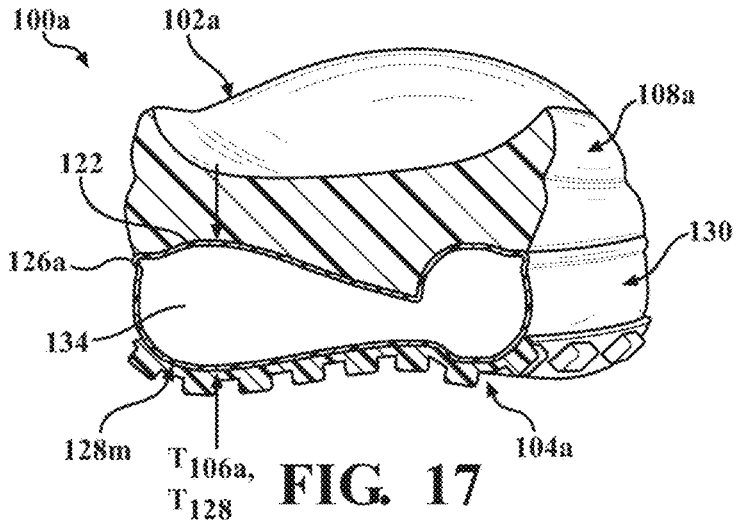
FIG. 17 is a cross-sectional view of the sole structure of FIG. 14, taken along Line 17-17 of FIG. 14.
Figure 18:
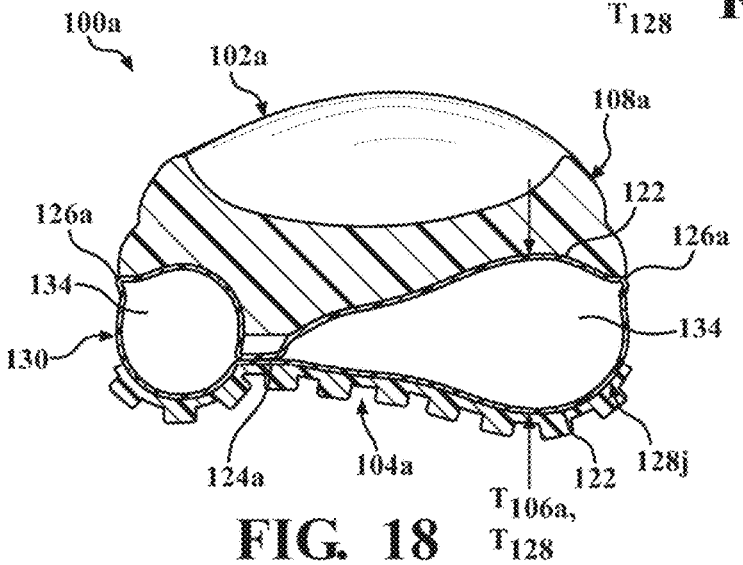
FIG. 18 is a cross-sectional view of the sole structure of FIG. 14, taken along Line 18-18 of FIG. 14.
Figure 19:
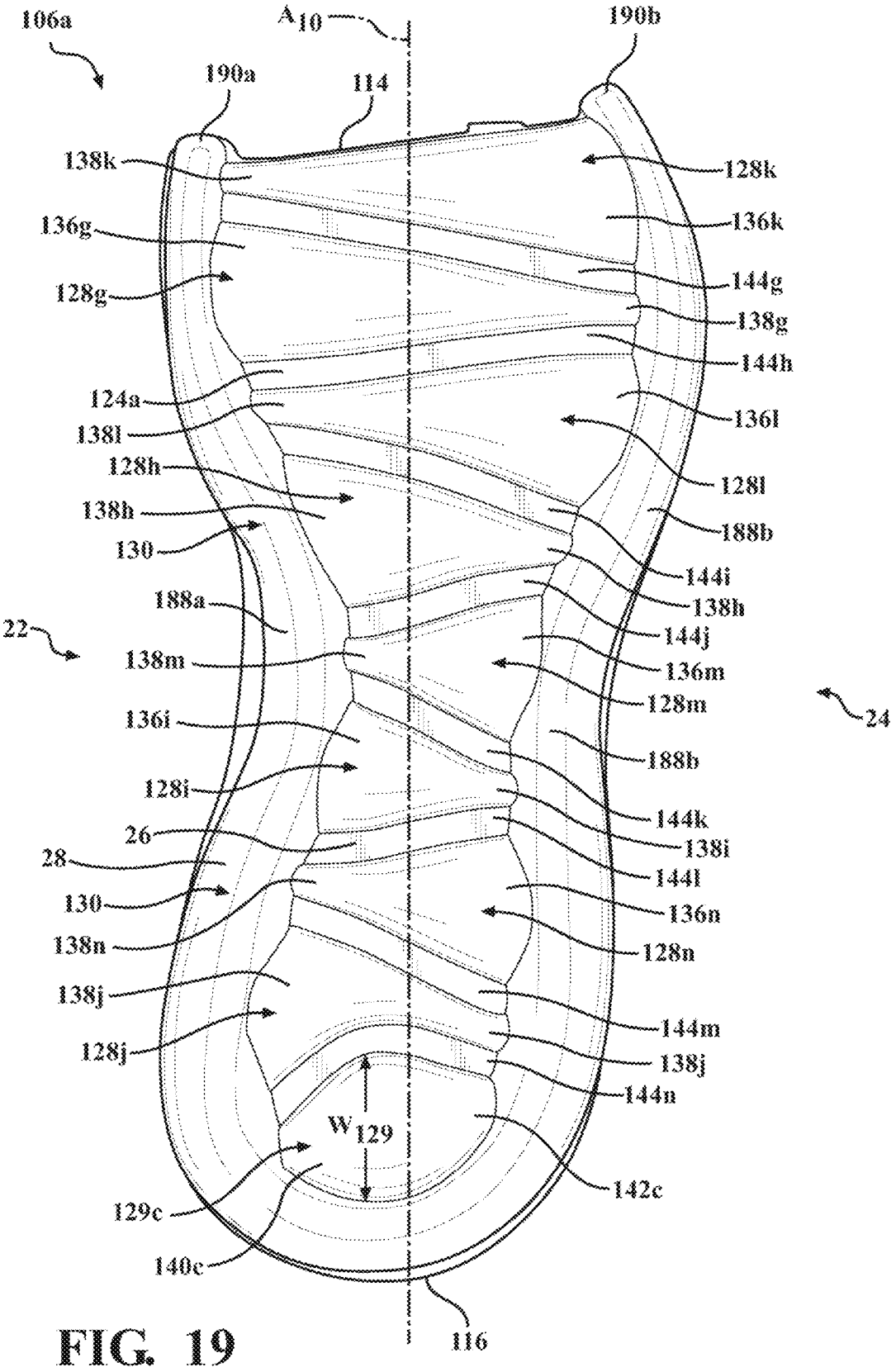
FIG. 19 is a top plan view of a bladder in accordance with the principles of the present disclosure, for use with the article of footwear of FIG. 10.
Figure 20:
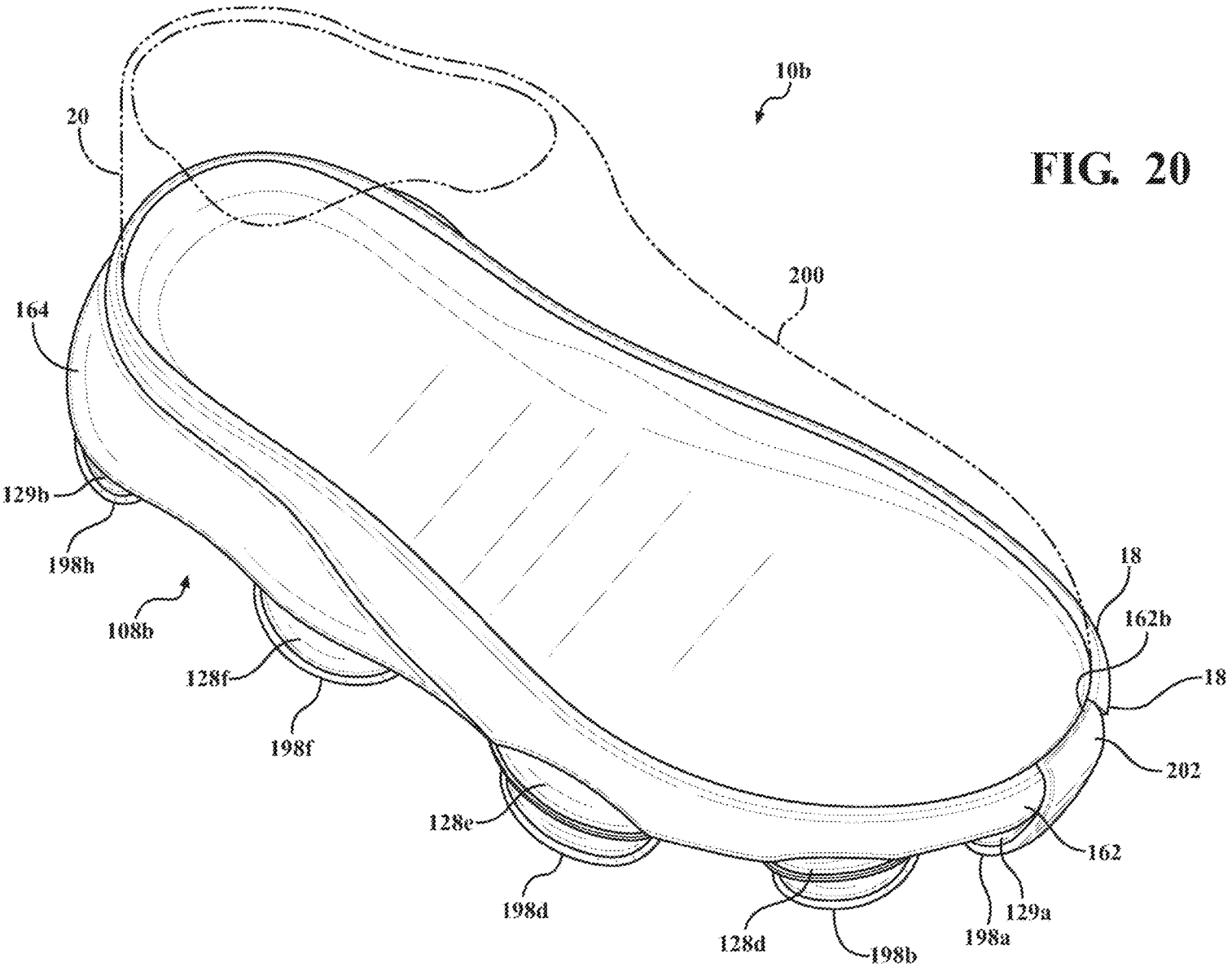
FIG. 20 is a perspective view of an article of footwear including a sole structure in accordance with the principles of the present disclosure.

Turning now to FIG. 19, the bladder 106*a* includes a plurality of the tapered chambers 128*g*-128*n* each having a length extending substantially perpendicular to the longitudinal axis $A_{10a}$, from a first end 136*g*-136*n* on one of the medial side 22 or the lateral side 24 of the bladder 106*a* to a second end 138*g*-138*n* on the other of the medial side 22 or the lateral side 24 of the bladder 106*a*. Here, widths $W_{128}$ of each of the tapered chambers 128*g*-128*n* are measured along a direction of the longitudinal axis $A_{10a}$ and are defined by adjacent segments of the web area 124*a*. With reference to FIGS. 15-18, thicknesses $T_{128}$ of the tapered chambers 128*g*-128*n* correspond to the thickness $T_{106a}$ of the bladder 106*a* measured at each of the respective tapered chambers 128*g*-128*n*. As discussed in greater detail below, the widths $W_{128}$ and thicknesses $T_{128}$ of each of the tapered chambers 128*g*-128*n* taper across the width of the bladder 106*a* from the first end 136*g*-136*n* to the second end 138*g*-138*n*. Accordingly, each of the tapered chambers 128*g*-128*n* may also be described as having tapering cross-sections along the lengthwise direction.

With continued reference to FIG. 19, the tapered chambers 128*a*-128*h* may be described as including a series of first tapered chambers 128*g*-128*j* that taper in a first direction and a series of second tapered chambers 128*k*-128*n* that taper in an opposite second direction. As shown, the first tapered chambers 128*g*-128*j* are alternatingly arranged with the second tapered chambers 128*k*-128*n* along the length of the bladder 106*a*, such that one of the second tapered chambers 128*d*-128 is interposed between consecutive ones of the first tapered chambers 128*g*-128*j* and vice versa. Accordingly, the first tapered chambers 128*g*-128*j* and the second tapered chambers 128*k*-128*n* are arranged in an alternating series from the forefoot region 12 to the heel region 16.

The first tapered chambers 128*g*-128*j* extend from respective ones of the first ends 136*g*-136*j* on the medial side 22 of the bladder 106*a* to respective ones of the second ends 138*g*-138*j* on the lateral side 24 of the bladder 106*a*. The first tapered chambers 128*g*-128*j* taper in the direction from the first end 136*g*-136*j* to the second end 138*g*-138*j*, such that a cross-sectional area of the interior void 134 is greater at the medial side 22 than at the lateral side 24. The second tapered chambers 128*k*-128*n* extend from respective ones of the first ends 136*k*-136*n* on the lateral side 24 of the bladder 106*a* to respective ones of the second ends 138*k*-138*n* on the medial side 22 of the bladder 106*a*. The second tapered chambers 128*k*-128*n* taper in the direction from the first end 136*k*-136*n* to the second end 138*k*-138*n*, such that a cross-sectional area of the interior void 134 is greater at the lateral side 24 than at the medial side 22.

Figure 16:
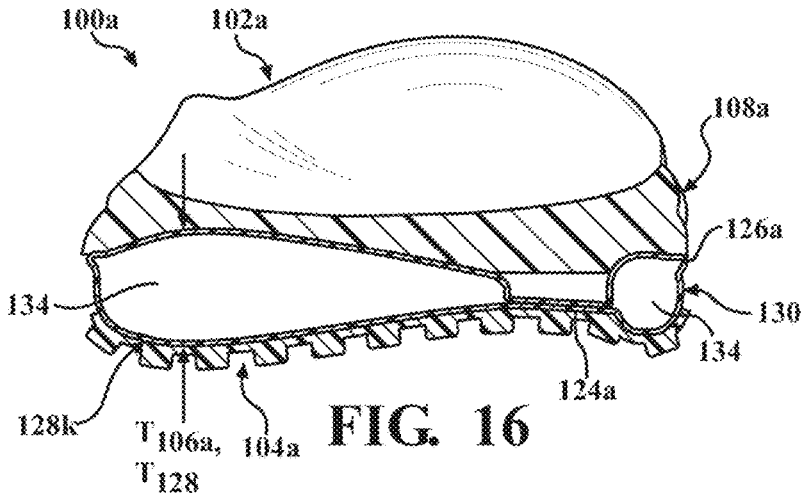
FIG. 16 is a cross-sectional view of the sole structure of FIG. 14, taken along Line 16-16 of FIG. 14.

In some examples, the widths $W_{128}$ of each of the tapered chambers 128*g*-128*n* taper continuously from the first end 136*g*-136*n* to the second end 138*g*-138*n*. However, widths $W_{128}$ of one or more of the tapered chambers 128*g*-128*n* may have a variable taper defined by curved segments of the web area 124*a*. For example, one or more of the tapered chambers 128*g*-128*n* may have a first portion adjacent to the first end 136*g*-136*n* that tapers at a first rate, and a second portion adjacent to the second end 138*g*-138*n* that tapers at a second rate. In some examples, the second rate is less than the first rate, such that the widths $W_{128}$ of the tapered chambers 128*g*-128*n* define a bell-shaped profile. As illustrated in the example of FIGS. 16-18, thicknesses of each first tapered chambers 128*g*-128*j* also taper along the direction from the first end 136*g*-136*j* to the second end 138*g*-138*j*. Particularly, each of the first tapered chambers 128*g*-128*j* tapers from a maximum thickness adjacent to the first end 136*g*-136*j* on the medial side 22 to a minimum thickness adjacent to the second end 138*g*-138*j* on the lateral side 24. Conversely, each of the second tapered chambers 128*k*-128*n* tapers from a maximum thickness adjacent to the first end 136*k*-136*n* on the lateral side 24 to a minimum thickness adjacent to the second end 138*k*-138*n* on the medial side 22.

As shown, the end chamber 129*c* includes a posterior end chamber 129*c* disposed at the second end 116 of the bladder 106. A length of the end chamber 129*c* extends from a first end 140*c* on the medial side 22 to a second end 142*c* on the lateral side 24. Unlike the tapered chambers 128*g*-128*n*, which have widths $W_{128}$ defined by segments of the web area 124*a*, each of the end chamber 129*c* has a width $W_{129}$ measured from a portion of the web area 124*a* to a portion of the peripheral chamber 130 extending around the second end 116 of the bladder 106*a*. As such, the width $W_{129}$ of the end chamber 129*c* tapers from a central portion (i.e., adjacent to the longitudinal axis $A_{10}$) towards each of the medial and lateral sides 22, 24.

Adjacent ones of the interior chambers 128*g*-128*n*, 129*c* are separated from each other by segments of the web area 124*a*, such that opposing pairs of pockets or spaces 144*h*-

Figure 15:
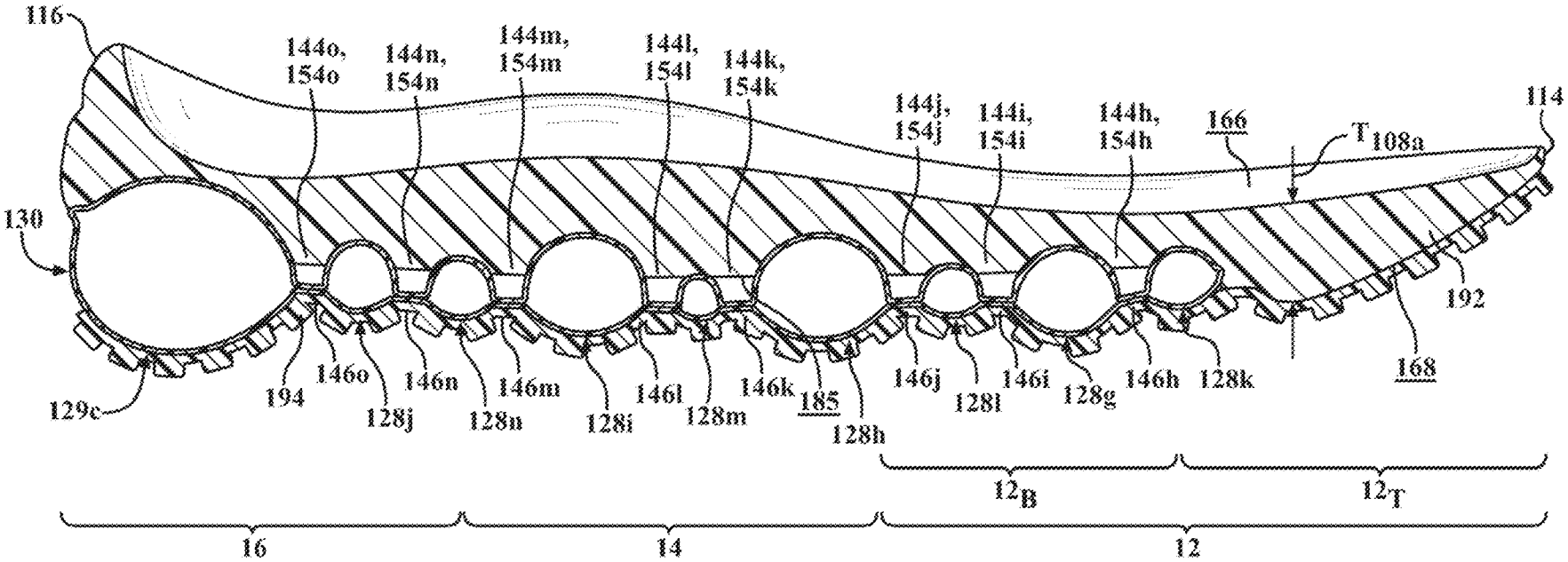
FIG. 15 is a cross-sectional view of the sole structure of FIG. 14, taken along Line 15-15 of FIG. 14.

144*o*, 146*h*-146*o* are formed on opposite sides 118, 120 of the bladder 106*a* between adjacent ones of the interior chambers 128*g*-128*n*, 129*c*, as best shown in FIG. 15. In other words, the bladder 106*a* includes a series of upper pockets 144*h*-144*o* formed by the web area 124*a* and adjacent interior chambers 128*g*-128*n*, 129*c* on the top side 118 of the bladder 106*a*, and a series of lower pockets 146*h*-146*o* formed by the web area 124*a* and adjacent interior chambers 128*g*-128*n*, 129*c* on the bottom side 120 of the bladder 106*a*.

In the example of the bladder 106*a* shown in FIGS. 10-19, the peripheral region 28 of the bladder 106*a* includes a peripheral chamber 130 extending along each of the medial side 22 and the lateral side 24 and connecting the respective ends 136*g*-136*n*, 138*g*-138*n* of the tapered chambers 128*g*-128*n*. For instance, a medial segment 188*a* of the peripheral chamber 130 extends from a first terminal end 190*a* at the first end 114 of the bladder 106*a* and along the peripheral region 28 on the medial side 22. The medial segment 188*a* connects and is in fluid communication with the first ends 136*g*-136*j* of the first tapered chambers 128*g*-128*j* and the second ends 138*k*-138*n* of the second tapered chambers 128*k*-128*n*. Likewise, a lateral segment 188*b* of the peripheral chamber 130 extends from a second terminal end 190*b* at the first end 114 of the bladder and along the peripheral region 28 on the lateral side 24. Here, the lateral segment 188*b* connects and is in fluid communication with each of the first ends 136*k*-136*n* of the second tapered chambers 128*k*-128*n* and the second ends 138*g*-138*j* of the first tapered chambers 128*g*-128*j*. In some examples, a heel segment 188*c* of the peripheral chamber 130 extends along the peripheral region 28 around the second end 116 and is fluidly connected to the end chamber 129*c*. Here, the heel segment 188*c* extends along an arcuate path from the medial segment 188*a* to the lateral segment 188*b*.

Figure 11:
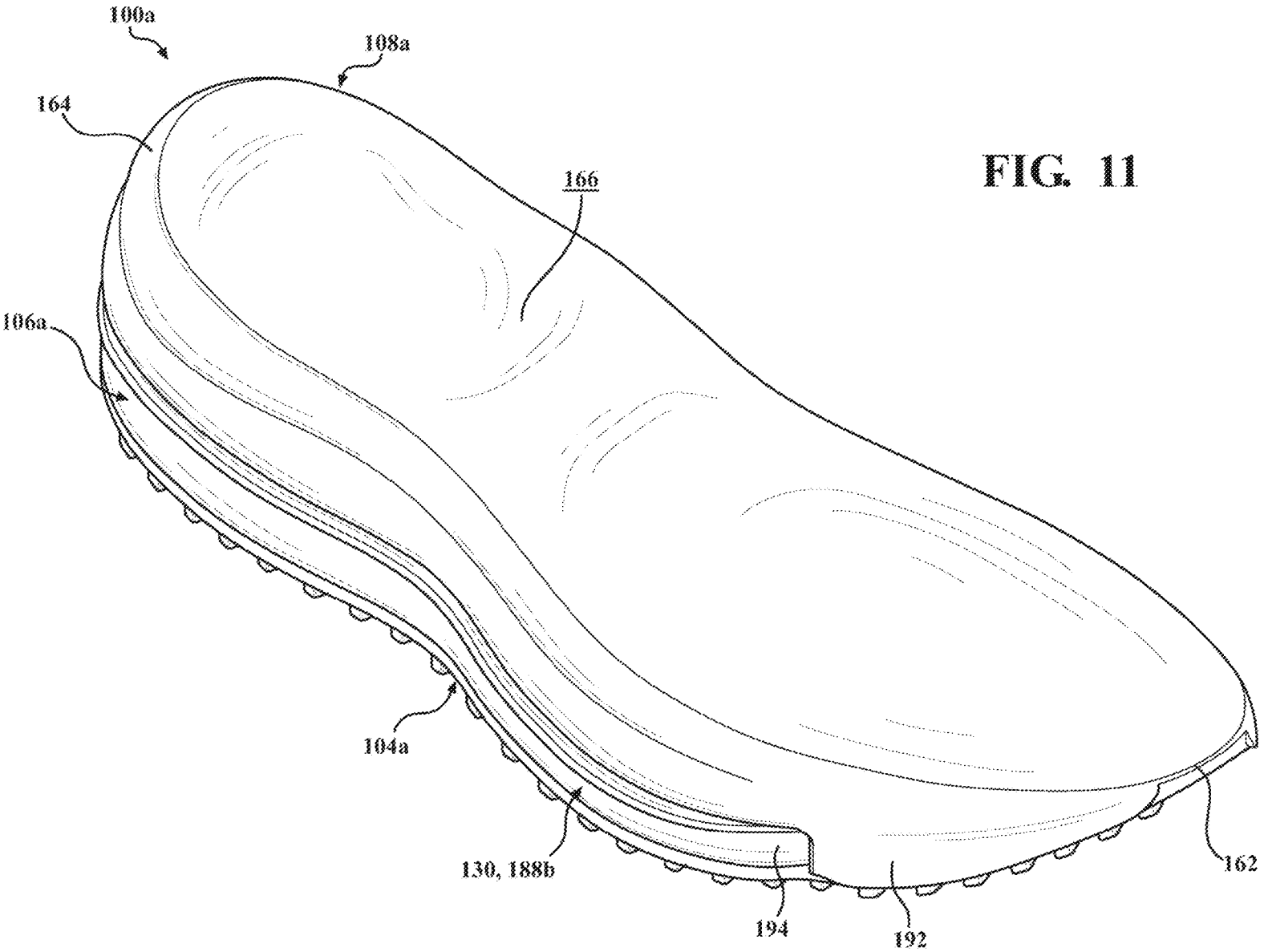
FIG. 11 is a perspective view of a sole structure in accordance with the principles of the present disclosure, for use with the article of footwear of FIG. 10.

With continued reference to FIGS. 11-13, the chassis 108*a* is configured to interface with the bladder 106*a* to provide a unitary midsole 102*a*. The chassis 108*a* may be formed of one or more resilient materials, as discussed above with respect to the chassis 108. The chassis 108*a* includes an upper ridge 150*a* having a series of upper ribs 154*h*-154*o* each configured to mate with one of the upper pockets 144*h*-144*o* of the bladder 106*a*. Accordingly, the upper ridge 150*a* is formed by consecutive ones of the ribs 154*h*-154*g* converging with and connecting to each other at one of the medial side 22 and the lateral side 24, such that a path along which the upper ridge 150*a* extends corresponds to a path of the web area 124*a* along the interior region 26 of the bladder 106*a*.

With particular reference to FIGS. 12 and 13, the chassis 108*a* extends from a first end 162 at the anterior end 18 of the sole structure 100*a* to a second end 164 at the posterior end 20 of the sole structure 100*a*. The chassis 108*a* further includes the top surface 166 defining a footbed, and the bottom surface 168 formed on the opposite side of the chassis 108*a* than the top surface 166. A distance from the top surface 166 to the bottom surface 168 defines a thickness $T_{108a}$ of the chassis 108*a*. The bottom surface 168 defines a toe pad 192 and a recess 194 along the bottom side of the chassis 108*a*. The toe pad 192 extends from the first end 162 of the chassis 108*a* to an intermediate portion of the forefoot region 12. For example, the toe pad 192 of the illustrated example terminates between a toe portion 12T and a ball portion 12B of the forefoot region 12. As shown, a posterior-facing surface of the toe pad 192 defines an anterior end of the recess 194. The recess 194 extends continuously from the ball portion 12B to the second end 116 of the chassis 108*a*. The recess 194 is configured to receive the bladder 106*a* and to interface with the top side 118 of the bladder 106*a*.

The portion of the bottom surface 168 forming the recess 194 of the chassis 108*a* includes an upper ridge 150*a* having a plurality of elongate upper ribs 154*h*-154*o* joined to each other at the medial side 22 or the lateral side 24. Here, each of the upper ribs 154*h*-154*o* corresponds to one of the upper pockets 144*h*-144*o* formed in the bladder 106*a*, such that when the chassis 108*a* is assembled with the bladder 106*a*, one of the upper ribs 154*h*-154*o* is received within one of the upper pockets 144*a*-144*g*. As shown, consecutive ones of the upper ribs 154*h*-154*o* converge with and are connected to each other at the second ends 138*g*-138*n* of each of the tapered chambers 128*g*-128*n*, such that the upper ribs 154*h*-154*o* are arranged in an alternating series along the length of the chassis 108*a*.

In the illustrated example, a height $H_{150a}$ of the upper ridge 150*a* (measured from the bottom surface 168 to a distal end surface 185 of the upper ridge 150*a*) is selected such that at least a portion of the upper ridge 150*a* does not extend fully into the upper pockets 144*h*-144*o*. Thus, as shown in FIG. 15, the distal end surface 185 of the upper ridge 150*a* is spaced apart from the web area 124*a* to form a void or space between the upper ridge 150*a* and the web area 124*a*.

In some examples, the outsole 104*a* extends over the midsole 102*a* to provide increased durability and resiliency. In the illustrated example, the outsole 104*a* is provided as a continuous piece that is overmolded onto the toe pad 192 and the bottom side 120 of the bladder 106*a* to provide increased durability to the midsole 102*a*. Accordingly, the outsole 104*a* is formed of a different material than the bladder 106*a* and the chassis 108*a*, and includes at least one of a different thickness, a different hardness, and a different abrasion resistance than the lower barrier layer 122. In some examples, the outsole 104*a* may be formed integrally with the lower barrier layer 122 of the bladder 106*a* using an overmolding process. In other examples the outsole 104*a* may be formed separately and adhesively bonded to the lower barrier layer 122 and the toe pad 192.

Referring now to FIGS. 20-24, an article of footwear 10*b* is provided and includes a sole structure 100*b* and the upper 200 attached to the sole structure 100*b*. In view of the substantial similarity in structure and function of the components associated with the article of footwear 10*b* with respect to the article of footwear 10, 10*a*, like reference numerals are used hereinafter and in the drawings to identify like components while like reference numerals containing letter extensions are used to identify those components that have been modified.

Figure 22:
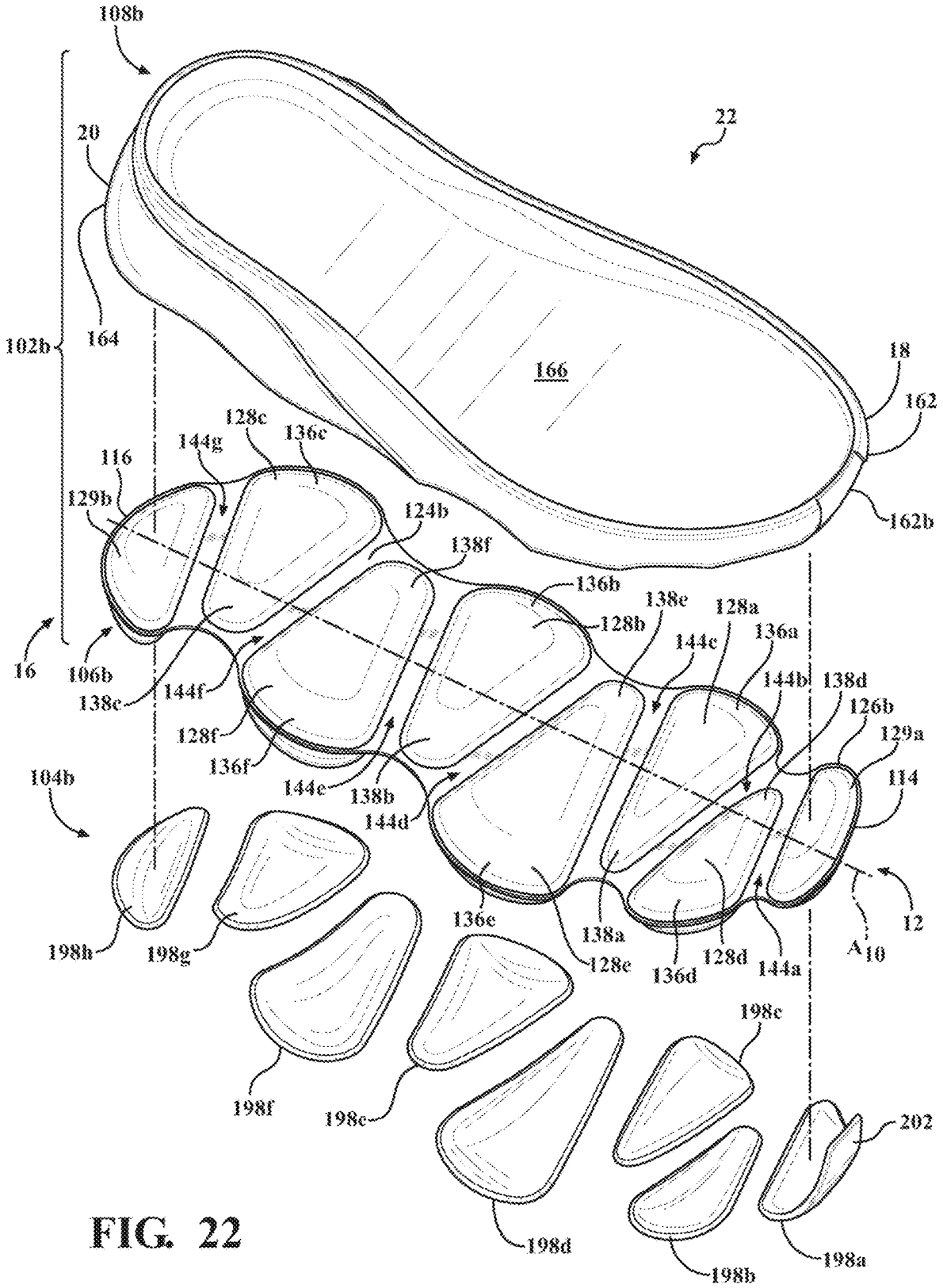
FIG. 22 is an exploded top perspective view of a sole structure in accordance with the principles of the present disclosure, for use with the article of footwear of FIG. 20.
Figure 23:
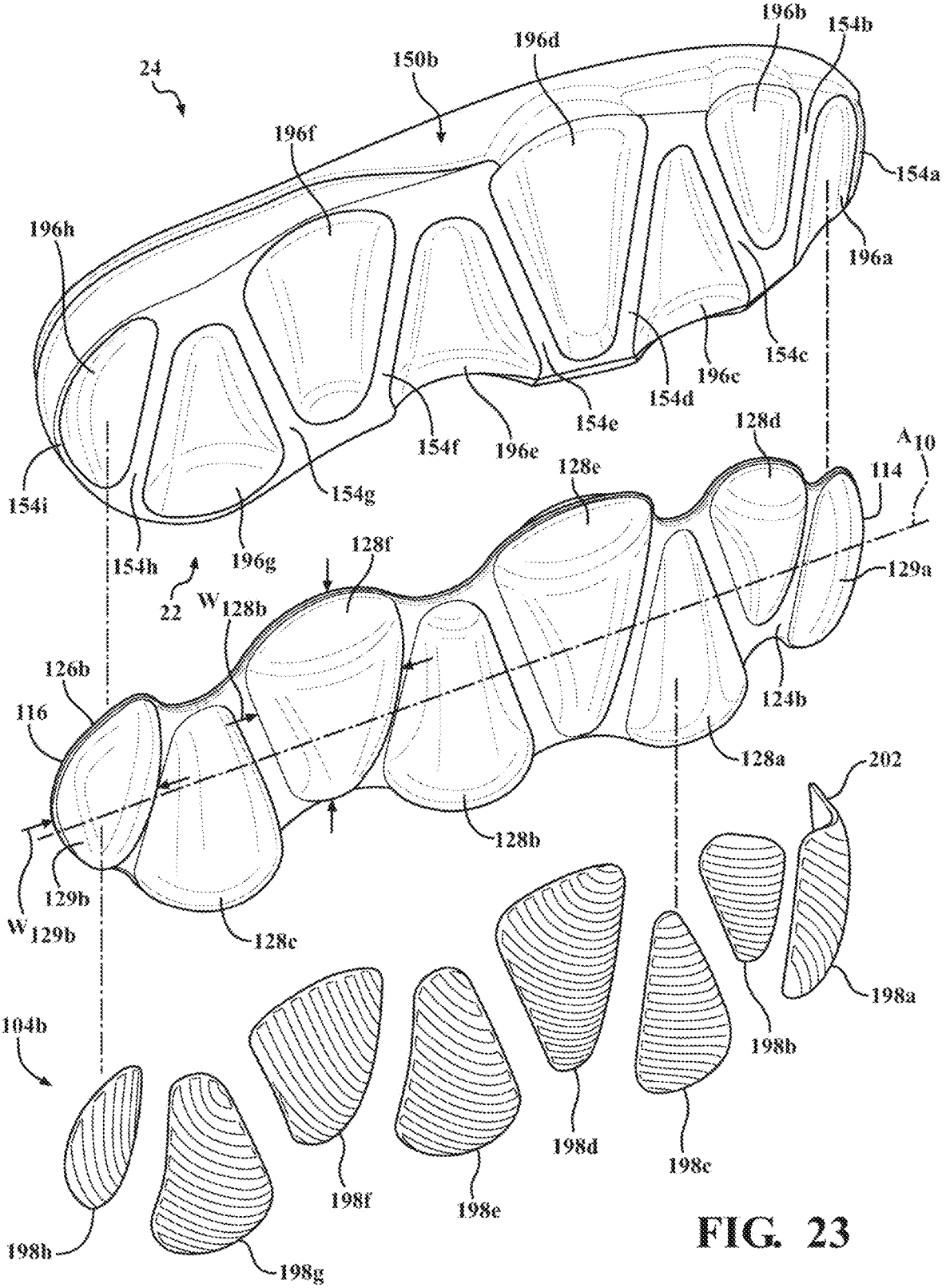
FIG. 23 is an exploded bottom perspective view of a sole structure in accordance with the principles of the present disclosure, for use with the article of footwear of FIG. 20.

With reference to FIGS. 22 and 23, the sole structure 100*b* includes a midsole 102*b* configured to provide cushioning characteristics to the sole structure 100*b*, and an outsole 104*b* configured to provide a ground-engaging surface of the article of footwear 10*b*. The midsole 102*b* includes a bladder 106*b* and a chassis 108*b*, where the chassis 108*b* is attached to the upper 200 and provides an interface between the upper 200 and the bladder 106*b*. Unlike the previous example, where the chassis 108 included upper and lower elements 110, 112, the chassis 108*b* of the present example is formed of a single upper component 108*b* disposed between the bladder 106*b* and the upper 200.

With continued reference to FIGS. 22 and 23, a length of the bladder 106*b* extends from the first end 114, which terminates at the toe portion 12T in the forefoot region 12, to the second end 116 in the heel region 16, which terminates adjacent to the posterior end 20 of the heel portion 16. The bladder 106*b* may be further described as including the top surface or side 118 and the bottom surface or side 120 formed on an opposite side of the bladder 106*b* from the top side 118. As discussed in greater detail below, thicknesses $T_{106b}$ of the bladder 106*b*, or of elements of the bladder 106*b*, are defined by a distance from the top side 118 to the bottom side 120.

Figure 21:
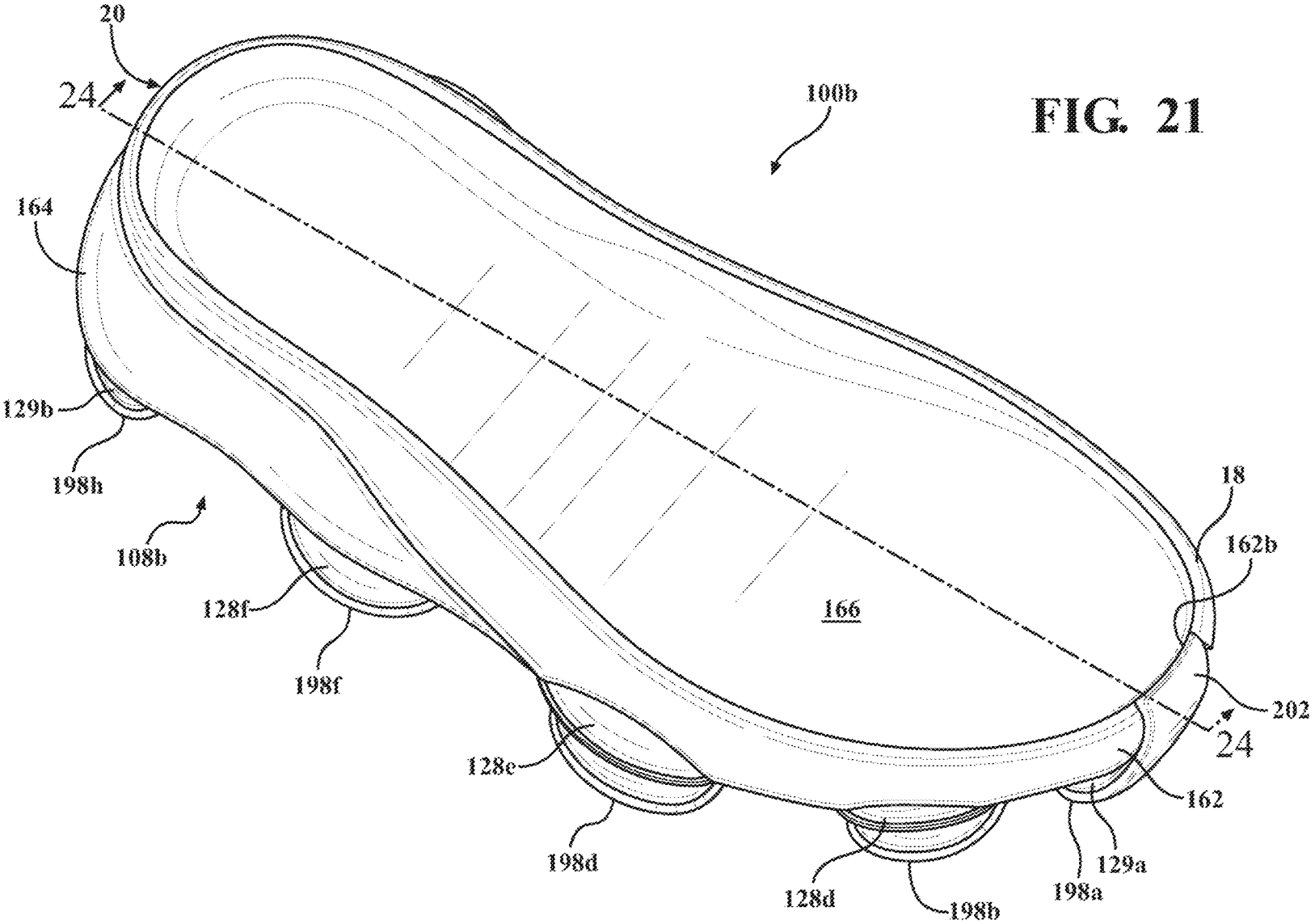
FIG. 21 is a perspective view of a sole structure in accordance with the principles of the present disclosure, for use with the article of footwear of FIG. 20.
Figure 24:
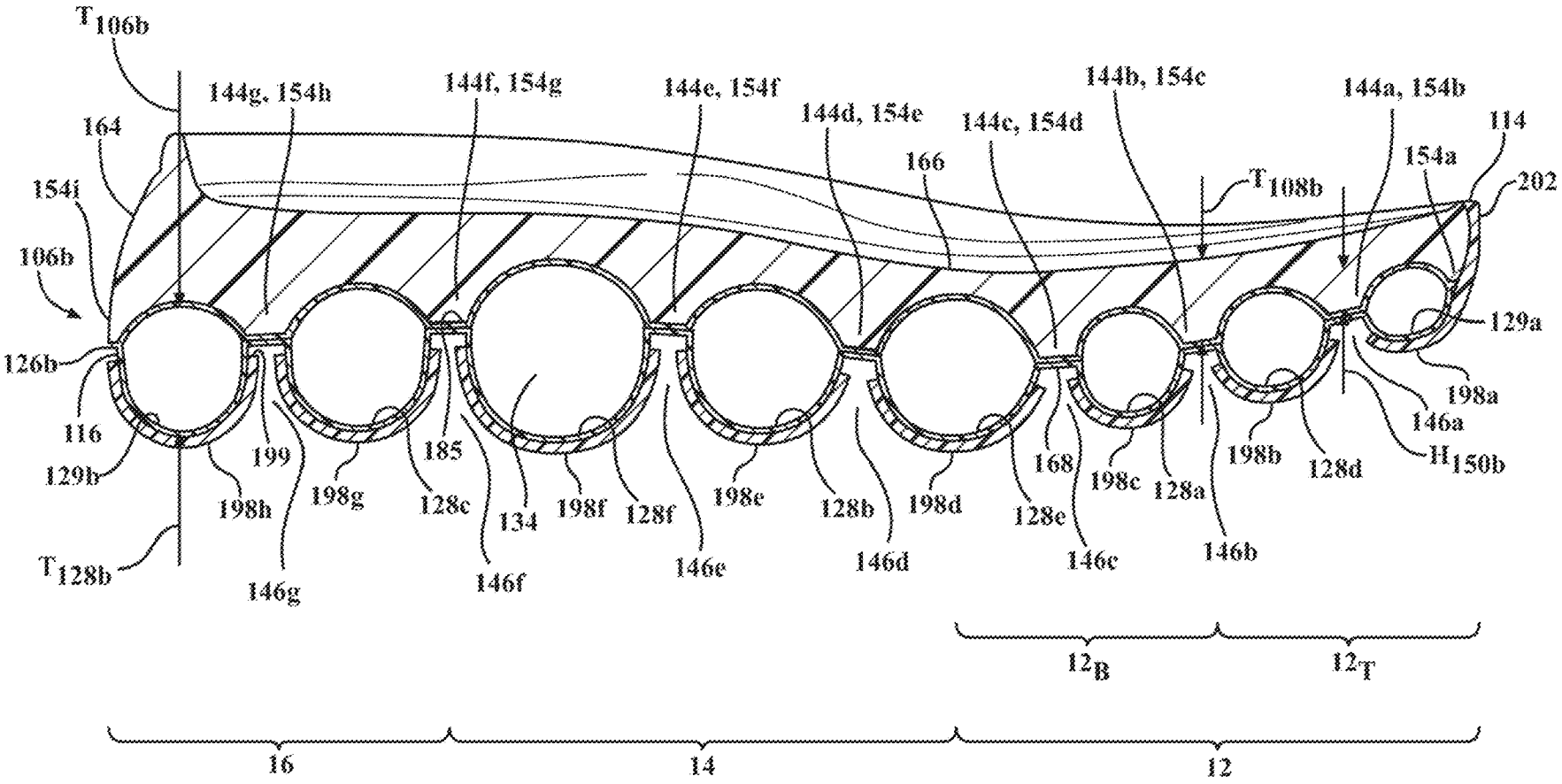
FIG. 24 is a cross-sectional view of the sole structure of FIG. 22, taken along Line 24-24 of FIG. 22.

FIG. 24 provides a cross-sectional view of the bladder 106*b* shown in FIG. 21. The bladder 106*b* may be formed by an opposing pair of the barrier layers 122, which can be joined to each other at discrete locations to define an overall shape of the bladder 106*b*. Alternatively, the bladder 106*b* can be produced from any suitable combination of one or more barrier layers. In the shown configuration, the barrier layers 122 include a first, upper barrier layer 122 forming the top side 118 of the bladder 106*b*, and a second, lower barrier layer 122 forming the bottom side 120 of the bladder 106*b*. In the illustrated example, interior, opposing surfaces (i.e. facing each other) of the barrier layers 122 are joined together at discrete locations to form a web area 124*b* and a peripheral seam 126*b*. The peripheral seam 126*b* extends around the outer periphery of the bladder 106*b* and defines an outer peripheral profile of the bladder 106*b*.

As shown in FIG. 24, the upper and lower barrier layers 122 are spaced apart from each other between the web area 124*b* and the peripheral seam 126*b* to define a plurality of chambers 128*a*-128*f*, 129*a*-129*b* each forming a respective portion of an interior void 134 of the bladder 106*b*. Each of the plurality of chambers 128*a*-128*f*, 129*a*-129*b* are closed off from each other by the web area 124*b* and the peripheral seam 126*b* so as to form a plurality of pockets 144*a*-144*g* disposed on opposite sides 118, 120 of the bladder 106*b*. The chambers 128*a*-128*f*, 129*a*-129*b* are arranged in series from the first end 114 of the bladder 106*b* to the second end 116 of the bladder 106*b*. Here, the chambers 128*a*-128*f*, 129*a*-129*b* include a plurality of tapered chambers 128*a*-128*f* arranged in series between a pair of end chambers 129*a*, 129*b* disposed at opposite ends 114, 116 of the bladder 106*b*.

Turning now to FIGS. 22 and 23, the bladder 106*b* includes a plurality of the tapered chambers 128*a*-128*f* each having a length extending substantially perpendicular to the longitudinal axis $A_{10}$, from a first end 136*a*-136*f* on one of the medial side 22 or the lateral side 24 of the bladder 106 to a second end 138*a*-138*f* on the other of the medial side 22 or the lateral side 24 of the bladder 106*b*. Here, widths $W_{128b}$ of each of the chambers 128*a*-128*f* are measured along a direction of the longitudinal axis $A_{10}$ and are defined by adjacent segments of the web area 124.

With reference again to FIG. 24, the thicknesses $T_{128b}$ of the tapered chambers 128*a*-128*f* correspond to the thickness $T_{106b}$ of the bladder 106*b* measured at each of the respective tapered chambers 128*a*-128*f*. As discussed in greater detail below, the widths $W_{128b}$ and thicknesses $T_{128b}$ (shown in FIG. 24) of each of the tapered chambers 128*a*-128*f* taper across the width of the bladder 106 from the first end 136*a*-136*f* to the second end 138*a*-138*f* Accordingly, each of the tapered chambers 128*a*-128*f* may also be described as having tapering cross-sections along the lengthwise direction.

With continued reference to FIG. 24, the tapered chambers 128*a*-128*f* may be described as including a series of first tapered chambers 128*a*-128*c* that taper in a first direction and a series of second tapered chambers 128*d*-128*f* that taper in an opposite second direction. As shown, the first tapered chambers 128*a*-128*c* are alternatingly arranged with the second tapered chambers 128*d*-128*f* along the length of the bladder 106, such that one of the second tapered chambers 128*d*-128*f* is interposed between consecutive ones of the first tapered chambers 128*a*-128*c* and vice versa. Accordingly, the first tapered chambers 128*a*-128*c* and the second tapered chambers 128*d*-128*f* are arranged in an alternating series from the forefoot region 12 to the heel region 16.

The first tapered chambers 128*a*-128*c* extend from respective ones of the first ends 136*a*-136*c* on the medial side 22 of the bladder 106*b* to respective ones of the second ends 138*a*-138*c* on the lateral side 24 of the bladder 106*b*. The first tapered chambers 128*a*-128*c* taper in the direction from the first end 136*a*-136*c* to the second end 138*a*-138*c*, such that a cross-sectional area of the interior void 134 is greater at the medial side 22 than at the lateral side 24. The second tapered chambers 128*d*-128*f* extend from respective ones of the first ends 136*d*-136*f* on the lateral side 24 of the bladder 106*b* to respective ones of the second ends 138*d*-138*f* on the medial side 22 of the bladder 106*b*. The second tapered chambers 128*d*-128*f* taper in the direction from the first end 136*d*-136*f* to the second end 138*d*-138*f*, such that a cross-sectional area of the interior void 134 is greater at the lateral side 24 than at the medial side 22. As shown, the first tapered chambers 128*a*-128*c* and the second tapered chambers 128*d*-128*f* oppose one another and each forms an edge with the web area 124. Edges of adjacent first tapered chambers 128*a*-128*c* and second tapered chambers 128*d*-128*f* may be substantially parallel to one another, as shown in FIGS. 22 and 23.

In some examples, the widths $W_{128}$ of each of the tapered chambers 128*a*-128*f* taper constantly and continuously from the first end 136*a*-136*f* to the second end 138*a*-138*f* The thicknesses of each of the tapered chambers 128*a*-128*f* also taper along the direction from the first end 136*a*-136*f* to the second end 138*a*-138*fc* so as to provide a generally cone shaped structure. Particularly, each of the tapered chambers 128*a*-128*f* tapers from a maximum thickness adjacent to the first end 136*a*-136*f* to a minimum thickness adjacent to the second end 138*a*-138*f*

As shown, the end chambers 129*a*, 129*b* include an anterior end chamber 129*a* disposed at the anterior end 18 and a posterior end chamber 129*b* disposed at the posterior end 20. Lengths of each of the end chambers 129*a*, 129*b* extend from a first end 140*a*, 140*b* on the medial side 22 to a second end 142*a*, 142*b* on the lateral side 24. Unlike the tapered chambers 128*a*-128*f*, which have widths $W_{128b}$ defined by segments of the web area 124*b*, each of the end chambers 129*a*, 129*b* has a width $W_{129b}$ measured from a portion of the web area 124 to a portion of the peripheral seam 126 extending around one of the ends 114, 116 of the bladder 106*b*. As such, the widths $W_{129b}$ of the end chambers 129*a*, 129*b* taper from a central portion (i.e., adjacent to the longitudinal axis $A_{10}$) towards each of the medial and lateral sides 22, 24.

With continued reference to FIGS. 21-24, the chassis 108*b* is configured to interface with the bladder 106*b* to provide a unitary midsole 102*b*. The chassis 108*b* may be formed of one or more resilient materials, as discussed above with respect to the chassis 108. The chassis 108*b* includes a plurality of bottom pockets 196*a*-196*h* formed on the bottom surface 168 of the chassis 108*b*. The bottom pockets 196*a*-196*h* are arranged in series from the first end 162 of the chassis 108*b* to the second end 164 of the chassis 108*b*. Each of the bottom pockets 196*a*-196*h* are spaced apart from the other and dimensioned to receive a top portion of a respective chamber 128*a*-128*f*, 129*a*-129*b*.

The bottom pockets 196*a*-196*h* define an upper ridge 150*b* having a series of upper ribs 154*a*-154*i* each configured to mate with corresponding sides of the top portion of each chamber 128*a*-128*f*, 129*a*, 129*b* of the bladder 106*b*. Accordingly, upper ridges 154*b*-154*h* are seated with a corresponding upper pocket 144*a*-144*g* of the bladder 106*b*. In one aspect, the upper ridges 154*b*-154*h* may be configured to be seated against the web area 124*b*. The upper ridge 150*b* is formed by consecutive ones of the ribs 154*a*-154*i* converging with and connecting to each other at one of the medial side 22 and the lateral side 24, such that a path along which the upper ridge 150*a* extends corresponds to a path of the web area 124*b* along the interior region 26 of the bladder 106*a*. The anterior upper ridge 154*a* and the posterior ridge 154*i* may be configured to be seated against the respective anterior and posterior portion of the peripheral seam 126*a* or may be spaced apart from the respective anterior and posterior portion of the peripheral seam 126*a*.

With particular reference to FIGS. 22 and 23, the chassis 108*b* extends from a first end 162 at the anterior end 18 of the sole structure 100*b* to a second end 164 at the posterior end 20 of the sole structure 100*b*. The first end 162 of the chassis 108*b* may include a lip receiving portion 162*b* formed by an indentation. The chassis 108*b* further includes the top surface 166 defining a footbed, and the bottom surface 168 formed on the opposite side of the chassis 108*b* than the top surface 166. A distance from the top surface 166 to the bottom surface 168 defines a thickness Tim, of the chassis 108*b*.

The upper ribs 154*b*-154*h* corresponds to one of the upper pockets 144*a*-144*g* formed in the bladder 106*a*, such that when the chassis 108*b* is assembled with the bladder 106*b*, one of the upper ribs 154*b*-154*h* is received within one of the upper pockets 144*a*-144*g*. As shown, consecutive ones of the upper ribs 154*a*-154*i* converge with and are connected to each other at the second ends 138*a*-138*f*, 142*c* of each of the chambers 128*a*-128*f*, 129*a*-129*b*, such that the upper ribs 154*a*-154*i* are arranged in an alternating series along the length of the chassis 108*b*.

In the illustrated example, a height $H_{150b}$ of the upper ridge 150*b* (measured from the nadir of the respective bottom pocket 196*a*-196*h* to a distal end surface 185 of the upper ridge 150*b*) is selected such that the ridge 150*b* is fully seated into the upper pockets 144*a*-144*g*. However, the height $H_{150b}$ of the upper ridge 150*b* may be configured such that the distal end surface 185 of the upper ridge 150*b* is spaced apart from the web area 124*b* to form a void or space between the ridge 150*b* and the web area 124*b*, similar to what is shown in FIG. 15.

In some examples, the outsole 104*b* extends over the midsole 102 to provide increased durability and resiliency. As shown in FIGS. 21-24, the outsole 104*b* is provided as a plurality of fragments 198*a*-198*h* that are overmolded onto the bladder 106*b* to provide increased durability to the exposed portions of the lower barrier layer 122 of the bladder 106*b*. Accordingly, the outsole 104*b* is formed of a different material than the bladder 106*b*, and includes at least one of a different thickness, a different hardness, and a different abrasion resistance than the lower barrier layer 122.

As shown in FIG. 24, each fragment 198*a*-198*h* is attached to a bottom portion of a respective chamber 128*a*-128*f*, 129*a*-129*b*. The peripheral edge 199 of the fragments 198*a*-198*h* may be configured to be spaced apart from the web area 124*b* and the anterior and posterior portion of the peripheral seam 126*b*, as the case may be, exposing a portion of the respective chamber 128*a*-128*f*, 129*a*-129*b*. As such, the individual chambers 128*a*-128*f*, 129*a*-129*b* are free to expand from a compressive force more freely adjacent the web area 124*b* relative to the areas that are covered by the fragments 198*a*-198*h*. The anterior fragment 198*a* may be configured to include a lip portion 202 that extends upwardly so as to be seated into the lip receiving portion 162*b* of the chassis 108*b*. Preferably, the lip portion 202 is secured to the lip receiving portion 162*b* by an adhesive. In some examples, the outsole 104*b* may be formed integrally with the lower barrier layer 122 of the bladder 106*b* using an overmolding process. In other examples the outsole 104*b* may be formed separately from the lower barrier layer 122 of the bladder 106*b* and may be adhesively bonded to the lower barrier layer 122.

As set forth in the examples above, the present disclosure relates to providing sole structures 100, 100*a*, 100*b* for an article of footwear 10, 10*a*, 10*b* that include a bladder 106, 106*a*, 106*b* having a plurality of alternatingly-arranged tapered chambers placed in series along a length of the sole structure 100, 100*a*, 100*b* and a foam chassis 108, 108*a*. 108*b* configured to mate with the bladder 106, 106*a*, 106*b*. This configuration provides a combination of fluid and foam cushioning along a length of the sole structure 100, 100*a*, 100*b* where the bladder 106, 106*a*, 106*b* provides a lightweight cushioning structure and the chassis 108, 108*a*, 108*b* is configured to distribute forces associated with individual ones of the chambers across a greater area of the foot.

The following Clauses provide exemplary configurations for the sole structures and articles of footwear described above.

Clause 1. A sole structure for an article of footwear, the sole structure comprising a bladder having a plurality of tapered chambers including (a) a series of first tapered chambers tapering from a first end on a medial side of the bladder to a second end on a lateral side of the bladder, and (b) one or more second tapered chambers tapering from a first end on the lateral side of the bladder to a second end on the medial side of the bladder, each of the one or more second tapered chambers interposed between adjacent ones of the first tapered chambers and a chassis having a first element disposed on a first side of the bladder and having a plurality of first ribs each disposed between adjacent ones of the first tapered chambers and the second tapered chambers.

Clause 2. The sole structure of Clause 1, wherein a width of each of the first tapered chambers and the second tapered chambers tapers from the first end to the second end.

Clause 3. The sole structure of any of the preceding Clauses, wherein a thickness of each of the first tapered chambers and the second tapered chambers tapers from the first end to the second end.

Clause 4. The sole structure of any of the preceding Clauses, wherein adjacent ones of the first tapered chambers and the second tapered chambers are connected by a web area.

Clause 5. The sole structure of Clause 4, wherein the web area defines a series of pockets between adjacent ones of the tapered chambers.

Clause 6. The sole structure of Clause 5, wherein a width each of the pockets is constant from the lateral side to the medial side.

Clause 7. The sole structure of any of the preceding Clauses, wherein each of the first ribs is connected to an adjacent one of the first ribs to form a continuous first ridge.

Clause 8. The sole structure of Clause 7, wherein the first ridge extends around the second end of each of the tapered chambers.

Clause 9. The sole structure of any of the preceding Clauses, wherein the first element includes a top surface forming a footbed of the sole structure and a bottom surface formed on an opposite side of the first element than the top surface, the first ribs extending from the bottom surface.

Clause 10. The sole structure of Clause 9, wherein the first element includes a plurality of openings formed through the top surface between adjacent ones of the first ribs.

Clause 11. The sole structure of Clause 10, wherein each one of the tapered chambers is exposed through a respective one of the openings.

Clause 12. The sole structure of any of the preceding Clauses, wherein the chassis further includes a second element disposed on an opposite side of the bladder from the first element and including a plurality of second ribs each disposed between adjacent ones of the first tapered chambers and the second tapered chambers.

Clause 13. The sole structure of Clause 12, wherein the second ribs oppose the first ribs across the bladder.

Clause 14. The soles structure of Clause 12, wherein ends of adjacent ones of the second ribs are connected to each other to form a continuous second ridge.

Clause 15. The sole structure of any of the preceding Clauses, wherein the tapered chambers are in fluid communication with one another.

Clause 16. A sole structure for an article of footwear, the sole structure comprising a bladder having a plurality of chambers including (a) a series of tapered chambers each extending from a medial side of the bladder to a lateral side of the bladder, and (b) a second chamber extending along at least one of one of the medial side of the bladder and the lateral side of the bladder and connecting each of the tapered chambers and a chassis having a plurality of ribs each disposed between adjacent ones of the tapered chambers.

Clause 17. The sole structure of any of the preceding Clauses, wherein a width of each of the tapered chambers tapers along a direction extending between the medial side and the lateral side.

Clause 18. The sole structure of any of the preceding Clauses, wherein a thickness of each of the tapered chambers tapers along a direction extending between the medial side and the lateral side.

Clause 19. The sole structure of any of the preceding Clauses, wherein adjacent ones of the tapered chambers are connected by a web area.

Clause 20. The sole structure of Clause 19, wherein the web area defines a series of pockets between the adjacent ones of the tapered chambers.

Clause 21. The sole structure of Clause 20, wherein a width of each of the pockets is constant from the lateral side to the medial side.

Clause 22. The sole structure of any of the preceding Clauses, wherein each of the plurality of ribs is connected to an adjacent one of the ribs to form a continuous ridge.

Clause 23. The sole structure of Clause 22, wherein the ridge extends around an end of each of the tapered chambers.

Clause 24. The sole structure of any of the preceding Clauses, wherein the chassis includes a top surface forming a footbed of the sole structure and a bottom surface formed on an opposite side than the top surface, the ribs extending from the bottom surface.

Clause 25. The sole structure of any of the preceding Clauses, wherein the second chamber includes a first segment extending along the medial side, a second segment extending along the lateral side, and a third segment extending from the first segment to the second segment.

Clause 26. A sole structure for an article of footwear, the sole structure comprising a bladder having a plurality of tapered chambers including (a) a series of first tapered chambers tapering from a first end on a medial side of the bladder to a second end on a lateral side of the bladder, and (b) one or more second tapered chambers tapering from a first end on the lateral side of the bladder to a second end on the medial side of the bladder, each of the one or more second tapered chambers interposed between adjacent ones of the first tapered chambers and a chassis disposed on a first side of the bladder and including a plurality of bottom pockets spaced apart from each other and defining a plurality of first ribs, the plurality of bottom pockets respectively receiving a top portion of the plurality of tapered chambers and each of the plurality of first ribs being disposed between adjacent ones of the first tapered chambers and the second tapered chambers.

Clause 27. The sole structure of Clause 26, wherein a width of each of the first tapered chambers and the second tapered chambers tapers from the first end to the second end.

Clause 28. The sole structure of any of the preceding Clauses, wherein a thickness of each of the first tapered chambers and the second tapered chambers tapers from the first end to the second end.

Clause 29. The sole structure of any of the preceding Clauses, wherein adjacent ones of the first tapered chambers and the second tapered chambers are connected by a web area.

Clause 30. The sole structure of Clause 29, wherein the web area defines a series of pockets between adjacent ones of the tapered chambers.

Clause 31. The sole structure of Clause 30, wherein a width each of the pockets is constant from the lateral side to the medial side.

Clause 32. The sole structure of any of the preceding Clauses, wherein each of the first ribs is connected to an adjacent one of the first ribs to form a continuous first ridge.

Clause 33. The sole structure of Clause 32, wherein the first ridge extends around the second end of each of the tapered chambers.

Clause 34. The sole structure of any of the preceding Clauses, further including an outsole, the outsole having a plurality of fragments, each of the plurality of fragments attached to a bottom portion of a corresponding one of the plurality of chambers.

Clause 35. The sole structure of Clause 34, wherein adjacent ones of the first tapered chambers and the second tapered chambers are connected by a web area, and wherein a peripheral edge of each of the plurality of fragments is spaced apart from the web area.

Clause 36. The sole structure of Clause 34, wherein the chassis includes a lip receiving portion disposed on an end of the chassis, and wherein one of the plurality of fragments includes a lip portion configured to be seated into the lip receiving portion of the chassis.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. A sole structure for an article of footwear having an upper, the sole structure comprising:

a midsole including an upper element having a first surface opposing the upper and a second surface formed on an opposite side of the upper element than the first surface and opposing a ground-engaging surface, the upper element including a plurality of apertures formed through a thickness of the upper element of the midsole between the first surface and the second surface;

a bladder including a plurality of chambers extending from a toe end of the bladder to a heel end of the bladder, wherein the heel end of the bladder at least partially defines a portion of a rearmost surface of the sole structure, each chamber of the plurality of chambers extending from a medial side of the midsole to a lateral side of the midsole and being received within respective apertures of the plurality of apertures and being visible at the first surface; and a conduit disposed within an interior region of the bladder and extending between each chamber of the plurality of chambers, the interior region circumscribed by a peripheral region defined between the interior region and an outer perimeter of each chamber of the plurality of chambers, each chamber of the plurality of chambers in fluid communication with an adjacent chamber of the plurality of chambers via a respective portion of the conduit.

2. The sole structure of claim 1, wherein the upper element includes a plurality of ribs extending from the medial side of the midsole to the lateral side of the midsole, the plurality of ribs defining the plurality of apertures.

3. The sole structure of claim 2, wherein ribs of the plurality of ribs are received between adjacent chambers of the plurality of chambers and oppose a web area of the bladder between the adjacent chambers.

4. The sole structure of claim 2, wherein adjacent ribs of the plurality of ribs cooperate to define each aperture of the plurality of apertures.

5. The sole structure of claim 2, wherein adjacent ribs of the plurality of ribs each includes an arcuate surface, the arcuate surfaces of the adjacent ribs opposing one another and cooperating to define a respective aperture of the plurality of apertures.

6. The sole structure of claim 1, wherein the midsole includes a lower element disposed on an opposite side of the bladder than the upper element, the lower element including a first surface opposing the bladder and a second surface formed on an opposite side of the lower element than the first surface of the lower element and opposing the ground-engaging surface.

7. The sole structure of claim 6, wherein the lower element includes a plurality of ribs extending from the medial side of the midsole to the lateral side of the midsole.

8. The sole structure of claim 7, wherein ribs of the plurality of ribs are received between adjacent chambers of the plurality of chambers and oppose a web area of the bladder between the adjacent chambers.

9. The sole structure of claim 6, wherein the upper element and the lower element are in contact with one another at a sidewall of the midsole between adjacent chambers of the plurality of chambers.

10. An article of footwear incorporating the sole structure of claim 1.

11. A sole structure for an article of footwear having an upper, the sole structure comprising:

a midsole including an upper element having a first surface opposing the upper and a second surface formed on an opposite side of the upper element than the first surface and opposing a ground-engaging surface, the upper element including a plurality of apertures formed through a thickness of the upper element of the midsole between the first surface and the second surface;

a bladder including a plurality of chambers extending from a toe end of the bladder to a heel end of the bladder, wherein the heel end of the bladder at least partially defines a portion of a rearmost surface of the sole structure, each chamber of the plurality of chambers extending from a medial side of the midsole to a lateral side of the midsole and being received within respective apertures of the plurality of apertures and protruding above the first surface of the upper element; and a conduit disposed within an interior region of the bladder and extending between each chamber of the plurality of chambers, the interior region circumscribed by a peripheral region defined between the interior region and an outer perimeter of each chamber of the plurality of chambers, each chamber of the plurality of chambers in fluid communication with an adjacent chamber of the plurality of chambers via a respective portion of the conduit.

12. The sole structure of claim 11, wherein the upper element includes a plurality of ribs extending from the medial side of the midsole to the lateral side of the midsole, the plurality of ribs defining the plurality of apertures.

13. The sole structure of claim 12, wherein ribs of the plurality of ribs are received between adjacent chambers of the plurality of chambers and oppose a web area of the bladder between the adjacent chambers.

14. The sole structure of claim 12, wherein adjacent ribs of the plurality of ribs cooperate to define each aperture of the plurality of apertures.

15. The sole structure of claim 12, wherein adjacent ribs of the plurality of ribs each includes an arcuate surface, the arcuate surfaces of the adjacent ribs opposing one another and cooperating to define a respective aperture of the plurality of apertures.

16. The sole structure of claim 11, wherein the midsole includes a lower element disposed on an opposite side of the bladder than the upper element, the lower element including a first surface opposing the bladder and a second surface formed on an opposite side of the lower element than the first surface of the lower element and opposing the ground-engaging surface.

17. The sole structure of claim 16, wherein the lower element includes a plurality of ribs extending from the medial side of the midsole to the lateral side of the midsole.

18. The sole structure of claim 17, wherein ribs of the plurality of ribs are received between adjacent chambers of the plurality of chambers and oppose a web area of the bladder between the adjacent chambers.

19. The sole structure of claim 16, wherein the upper element and the lower element are in contact with one another at a sidewall of the midsole between adjacent chambers of the plurality of chambers.

20. An article of footwear incorporating the sole structure of claim 11.

* * * * *